US006088871A

United States Patent [19]

Kobayashi

[11] Patent Number: 6,088,871

[45] Date of Patent: Jul. 18, 2000

[54] CLEANING EQUIPMENT

[76] Inventor: Yoshitada Kobayashi, 10-2, Matsubara 1-chome, Setagaya-ku, Tokyo, Japan

[21] Appl. No.: 08/913,176

[22] PCT Filed: Mar. 14, 1996

[86] PCT No.: PCT/JP96/00638

§ 371 Date: Sep. 11, 1997

§ 102(e) Date: Sep. 11, 1997

[87] PCT Pub. No.: WO96/28066

PCT Pub. Date: Sep. 19, 1996

[30] Foreign Application Priority Data

Mar. 14, 1995 [JP] Japan ..... 9-081914
Aug. 4, 1995 [JP] Japan ..... 7-219814

[51] Int. Cl.[7] ..... A46B 5/00

[52] U.S. Cl. ..... 15/220.1; 15/160; 15/209.1; 15/210.1; 15/228; 15/230; 15/230.12; 15/230.17; 15/104.94; 428/90

[58] Field of Search ..... 15/104.94, 143.1, 15/145, 159.1, 160, 180, 186, 208, 209.1, 219, 220.1, 228, 226, 230, 230.12, 230.14–230.17, 230.19; 428/90

[56] References Cited

U.S. PATENT DOCUMENTS

| | | | |
|---|---|---|---|
| 2,975,453 | 3/1961 | Imhof | 15/210.1 |
| 3,075,222 | 1/1963 | Miller | 15/230.12 X |
| 3,142,855 | 8/1964 | Gilchrist | 15/210.1 |
| 3,359,589 | 12/1967 | Moore | 15/210.1 |
| 3,421,171 | 1/1969 | Tsuruzawa | 15/160 X |
| 3,605,165 | 9/1971 | Burns | 15/210.1 |
| 3,924,286 | 12/1975 | Miller | 15/160 X |
| 4,134,173 | 1/1979 | Cupp et al. | 15/210.1 |
| 4,391,013 | 7/1983 | Janssen | 15/160 X |
| 5,331,710 | 7/1994 | Tollasepp | 15/210.1 |
| 5,438,728 | 8/1995 | Kubes et al. | 15/180 |
| 5,822,823 | 10/1998 | Polzin et al. | 15/160 X |

FOREIGN PATENT DOCUMENTS

| | | |
|---|---|---|
| 45-531 | 1/1970 | Japan . |
| 50-33557 | 4/1975 | Japan . |
| 54-155946 | 10/1979 | Japan . |
| 57-86162 | 5/1982 | Japan . |
| 60-167531 | 11/1985 | Japan . |
| 1-86948 | 6/1989 | Japan . |

*Primary Examiner*—Mark Spisich
*Attorney, Agent, or Firm*—Jones, Day, Reavis & Pogue

[57] ABSTRACT

Cleaning equipment according to this invention comprises a pile layer provided on a mount base portion composed of a hard plate body with a handle, a blockish grip portion having flexibility and elasticity, an engaged layer for engagement with a polisher, or the like. The pile layer comprises a multiplicity of monofilaments which are planted one by one while kept upright. Also, according to another concept of the invention, an end face of a free end portion of the pile layer is in the form of a substantially isogonal trapezoid or the like. With such arrangement, it is possible to easily, positively and very cleanly clean a surface being cleaned irrespective of roughness and degree of soiling of the surface being cleaned. Further, according to another concept, the surface being cleaned can be similarly cleaned even when the surface has corner portions and, therefor, obstacles are constituted around the surface.

72 Claims, 12 Drawing Sheets

10
12
12a
12b
12c
13
14
14
2
1
3
7
5
15
11a
11b
A
A
B
B
$\theta_0$

CLEANING EQUIPMENT

TECHNICAL FIELD

This invention relates to an improvement of cleaning equipment and, for particulars, to an improvement of a cleaning brush having a mounting base and a pile layer provided on at least one surface of the mounting base and, further, to an improvement of a cleaning pad having an engaged layer to be engaged with a polisher, such as an electrically rotated floor-polisher and the like, and a pile layer provided on one surface of the engaged layer, the pad being available when attached to the polisher.

BACKGROUND ART

The cleaning equipment, such as various kinds of scrub brushes, mops, various kinds of brushes each fastened to a long handle, and so forth is widely used for cleaning the surface (to be cleaned) of the body of a motor car; the outer wall, the inner wall, the window pane, the floor, the ceiling or the carpet of a building or an ordinary house; or a toilet stool or a lavatory sink, and the surface to be cleaned is treated with the planting portion or the like of the cleaning equipment after the planting portion or the like is impregnated with a liquid detergent or the like.

Furthermore, an electrically rotated floor-polisher is widely used for cleaning the floor of a building and so forth. In that event, a cleaning pad is removably attached to the lower surface of the driving pad of the electrically rotated floor-polisher. To easily attach the cleaning pad to the lower surface of the driving pad, the cleaning pad comprises a circular layer of non-woven material and is removably attached to the driving pad with a lot of engaging pins that protrude from the lower surface of the driving pad. At that time, the engaging pins are stuck into the midst of the layer of non-woven material.

Thereafter, the rotation of a driving motor accommodated in the floor polisher is transmitted to the cleaning pad through the driving pad and, to polish the floor, the rotating lower surface of the cleaning pad is brought into contact with the floor.

However, in the conventional cleaning equipment, it is very difficult to easily and surely clean the surface (to be cleaned) without any unclear portion if there is an obstacle around the surface like a surface having corner portions, such as glasses fitted in a window frame, corners of a bathroom or a toilet room, and so forth.

Moreover, even when the conventional cleaning equipment, such as the scrub brush, the mop, the brush fastened to the long handle and so forth, is used with the liquid detergent or the like, it is impossible to thoroughly clean a very soiled rough surface in a short period of time even if the irregularity of the surface is either small or rather large.

In case of the conventional cleaning equipment, such as the scrub brush, the mop, the brush fastened to the long handle and so forth, it is very difficult to easily, surely and thoroughly clean the surface (to be cleaned) that is so convex and/or concave as the body of the motor car is.

Moreover, in case of the conventional cleaning equipment, such as the electrically rotated floor-polisher, even when the polisher is used with the liquid detergent or the like, it is impossible to thoroughly clean a very soiled rough surface in a short period of time even if the irregularity of the surface is small.

Furthermore, in case of the various kinds of conventional cleaning equipment, there is such inconvenience that during the cleaning work after the planting portion is impregnated with the liquid detergent, the liquid detergent separated from the planting portion sprinkles anywhere in the vicinity of the planting portion.

DISCLOSURE OF INVENTION

Accordingly, it is an object of the present invention to provide a cleaning brush that can easily, surely and thoroughly clean a surface (to be cleaned) without any unclear portion though the surface (to be cleaned) is rough and soiled.

Another object of the invention is to provide a cleaning brush that can easily, surely and thoroughly clean a surface (to be cleaned) though the surface (to be cleaned) is a convex surface and/or a concave surface.

A further object of the invention is to provide a cleaning pad for a polisher, which can easily, surely and thoroughly clean a surface (to be cleaned) though the surface (to be cleaned) is rough and soiled.

In accordance with one aspect of this invention, as exemplified in a first embodiment (FIGS. 1–9) and in a second embodiment (FIGS. 10–17) described hereinafter, a cleaning brush comprises a mounting base and a pile layer provided on at least one of the surfaces of the mounting base, and the shape of the surface on the free-end side of the pile layer is characterized by:

(1) having a long-side edge substantially straightly extending over the whole length of the pile layer, (2) having an acutely projecting portion lying near each end of the long-side edge, and (3) providing a free space in which neither the mounting base nor the pile layer is, and which is bounded by both a first imaginary line passing through each distal end of and extending perpendicular to the long-side edge, and a second imaginary line passing through each distal end of the long-side edge and forming an acute angle of 4–40 degrees with the first imaginary line.

In the cleaning blush as exemplified in the first embodiment (FIGS. 1–9) in accordance with the one aspect of the invention, the mounting base is made of hard material and shaped into a substantially plate-like form; the one surface of the mounting base has a planting portion; the other opposite surface has a handle portion; and the planting portion has a backing layer provided on the one surface of the mounting base, and the pile layer provided on the backing layer. In that event, at least one of the following (A)–(D) constitutions is further included.

(A) The pile layer is constituted of a multiplicity of monofilaments planted on the backing layer one by one in a substantially upright state and in density of 1,000–50,000 monofilaments per $cm^2$ so that the thickness of the pile layer is 0.8–7.8 mm, and the fineness and the elastic modulus (when tested by ASTM, D638-52T) of the monofilament are 5–50 denier and 13,000–38,000 $kg/cm^2$, respectively.

(B) The mounting base is 1–10 mm in thickness and is shaped into a substantially plate-like form; a grip portion is provided so as to extend along the longer side of the other opposite surface of the mounting base and substantially in parallel with the other opposite surface; and the Shore hardness and the thickness of the backing layer are 40–80 and 0.5–5 mm, respectively.

(C) At least the long-side edge of at least the backing layer has an inclination starting at its lower end and slanting inwards to its upper end.

(D) The shape of the surface on the free-end side of the pile layer is further characterized by:

(4) having the long-side edge in length of 12–35 cm, (5) a maximum width of the pile layer being 4–15 cm, (6) being substantially the same shape as or a little larger than that of the lower surface of the mounting base, and (7) the acute angle of the free space being within 50–86 degrees.

In the cleaning brush as exemplified in the second embodiment (FIGS. 10–17) in accordance with the one aspect of the invention, the mounting base comprises a blockish grip portion having softness and elasticity; the blockish grip portion is formed out of foamed material having a thickness of 3–100 mm, a longitudinal elastic modulus of 0.4–3.0 kg/cm$^2$, and a porosity of 45–95%; the Shore hardness and the thickness of the backing layer are 35–75 and 0.6–6.0 mm, respectively; and the pile layer is constituted of a multiplicity of monofilaments planted on the backing layer one by one in a substantially upright state and in density of 1,000–50,000 monofilaments per cm$^2$ so that the thickness of the pile layer is 0.8–7.8 mm, and the fineness and the elastic modulus (when tested by ASTM, D638-52T) of the monofilament are 5–50 denier and 13,000–38,000 kg/cm$^2$, respectively.

In accordance with another aspect of this invention, as exemplified in the first embodiment (FIGS. 1–9) described hereinafter, a cleaning brush comprises a planting portion provided on one surface of a mounting base that is made of hard material and shaped into a substantially plate-like form, and a handle portion provided on the other surface of the mounting base, the planting portion having a backing layer provided on the one surface of the mounting base, and a pile layer provided on the backing layer; and the pile layer constituted of a multiplicity of monofilaments planted on the backing layer one by one in a substantially upright state.

In that event, at least one of the following (E) and (F) constitutions is further included.

(E) The pile layer is constituted of a multiplicity of monofilaments planted on the backing layer one by one in a substantially upright state and in density of 1,000–50,000 monofilaments per cm$^2$ so that the thickness of the pile layer is 0.8–7.8 mm, and the fineness and the elastic modulus (when tested by ASTM, D638-52T) of the monofilament are 5–50 denier and 13,000–38,000 kg/cm$^2$, respectively.

(F) At least one of the side edges of the mounting base and the backing layer has an inclination starting at the lower end of the backing layer and slanting inwards to the upper end of the mounting base, and the angle of the inclination is within the range of 30–60 degrees.

In accordance with a further aspect of the invention, as exemplified in the second embodiment (FIGS. 10–17) described hereinafter, a cleaning bush comprises a blockish grip portion having softness and elasticity, and a pile layer provided on at least one surface of the blockish grip portion, the pile layer is constituted of a multiplicity of monofilaments planted one by one in a substantially upright state.

In that event, at least one of the following (G)–(I) constitutions is further included.

(G) The pile layer is constituted of a multiplicity of monofilaments planted one by one in a substantially upright state and in density of 1,000–50,000 monofilaments per cm$^2$ so that the thickness of the pile layer is 0.8–7.8 mm, and the fineness and the elastic modulus (when tested by ASTM, D638-52T) of the monofilament are 5–50 denier and 13,000–38,000 kg/cm$^2$, respectively.

(H) A planting portion is provided on at least the one surface of the blockish grip portion; the planting portion has a backing layer provided on at least the one surface of the blockish grip portion, and the pile layer planted in the backing layer; the blockish grip portion is made of foamed material having a longitudinal elastic modulus of 0.4–3.0 kg/cm$^2$ and a porosity of 45–95%, and is in thickness of 3–100 mm; and the Shore hardness and the thickness of the backing layer are 35–75 and 0.6–6.0 mm, respectively.

(I) A planting portion is provided on at least the one surface of the blackish grip portion; the planting portion has a backing layer provided on at least the one surface of the blockish grip portion, and the pile layer planted in the backing layer; and at least one side edge of the backing layer has an inclination starting at its lower end and slanting inwards to its upper end.

In accordance with still a further aspect of this invention, as exemplified in the third embodiment (FIGS. 18–21) described hereinafter, a cleaning lead for a polisher, comprises an engaged layer to be engaged with the polisher, and a pile layer provided on one surface of the engaged layer, the pile layer being constituted of a multiplicity of monofilaments planted one by one in a substantially upright state; and the outer periphery of the engaged layer is of substantially circular shape so as to be engaged with engaging pins of an electrically rotated floor-polisher. In that event, at least one of the following (J) and (K) constitutions is further included.

(J) The pile layer is constituted of a multiplicity of monofilaments planted one by one in a substantially upright state and in density of 1,000–50,000 monofilaments per cm$^2$, so that the thickness of the pile layer is 0.8–7.8 mm, and the fineness and the elastic modulus (when tested by ASTM, D638-52T) of the monofilament are 5–50 denier and 13,000–38,000 kg/cm$^2$, respectively.

(K) A planting portion is provided on the one surface of the engaged layer; and the planting portion has a backing layer provided on the one surface of the engaged layer, and the pile layer planted in the backing layer.

Furthermore, this invention relates to an electrically rotated floor-polisher in which the aforementioned cleaning pad is removably attached to the driving pad thereof.

The features and technological advantages of this invention will be more understandable if the following explanation of the embodiments of this invention is grasped on reference to the annexed drawings.

BEST MODE OF CARRYING OUT THE INVENTION

Figure 1:
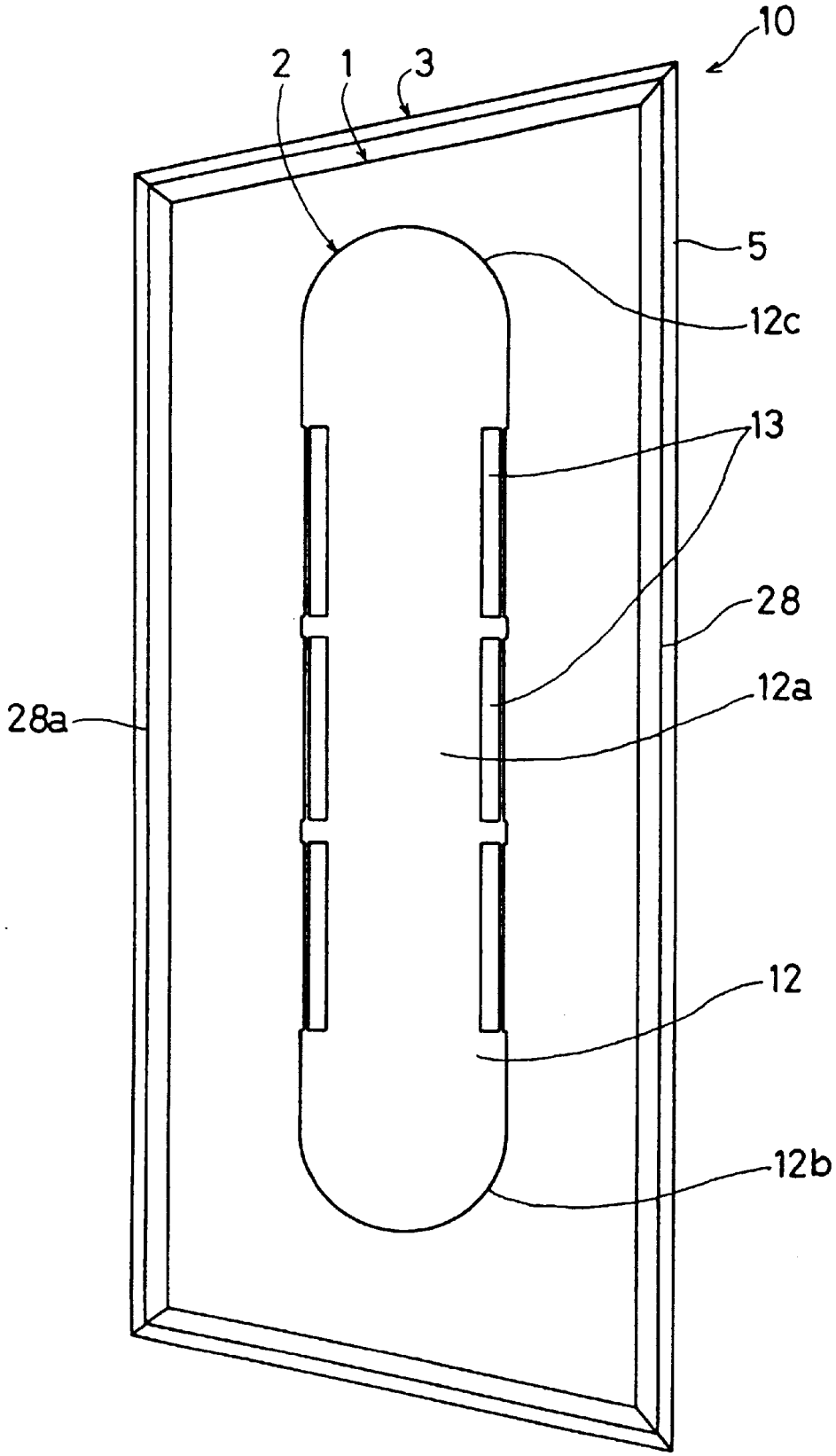
FIG. 1 is a plan view of a cleaning brush according to a first embodiment of this invention.

Referring to FIGS. 1–9, a cleaning brush according to a first embodiment of this invention will be described hereinafter.

The cleaning brush 10 according to the first embodiment of this invention comprises, particularly as shown in FIGS. 1–4, a narrow plate-like mounting base or bed 1, a handle portion 2 protruding from the upper surface of the mounting base 1, and a planting portion 3 attached to the lower surface of the mounting base 1.

The mounting base 1 may be made of hard resin, such as acrylic resin, polyvinyl chloride or the like and, in the first embodiment, is a substantially isogonal trapezoidal plate-like object longer in its longitudinal direction. In the illustrated first embodiment, the thickness of the plate-like object is about 3 mm but, from the usableness viewpoint, it is preferable to 1–10 mm and much preferable to 1.5–5 mm.

The handle portion 2 comprises, as plainly shown in FIGS. 1–4, a pair of substantially cylindrical boss portions 11*a*, 11*b*, which are positioned on the line passing substantially the center of the width (horizontal length in FIG. 1) of and symmetrically with respect to the line passing substantially the center of the length (vertical length in FIG. 1) of the flat upper surface of the mounting base 1, and formed integrally with the mounting base 1; and a substantially-inversed-U-shaped flat handle 12, which is attached to the mounting base 1 through the pair of boss portions 11*a*, 11*b*. The substantially-inversed-U-shaped flat handle 12 comprises a grip portion 12*a*, which extends substantially in parallel with the longer side of the upper surface of the mounting base 1 and is of substantially circular shape in section, and a pair of substantially cylindrical support portions 12*b*, 12*c*, which are formed integrally with the grip portion 12*a* so that the respective upper ends of the support portions 12*b*, 12*c* may be connected to both the ends of the grip portion 12*a* and the support portions 12*b*, 12*c* may extend substantially vertically downwards. The handle portion 2 may be made of hard plastic resin, such as acrylic resin, polyvinyl chloride or the like. Since the pair of boss portions 11*a*, 11*b* are fitted in and, if necessary, adhered to central hollows 14 provided in the pair of support portions 12*b*, 12*c*, respectively, the lower ends of the pair of support portions 12*b*, 12*c* are fixed to the mounting base 1 through the pair of boss portions 11*a*, 11*b*.

Figure 2:
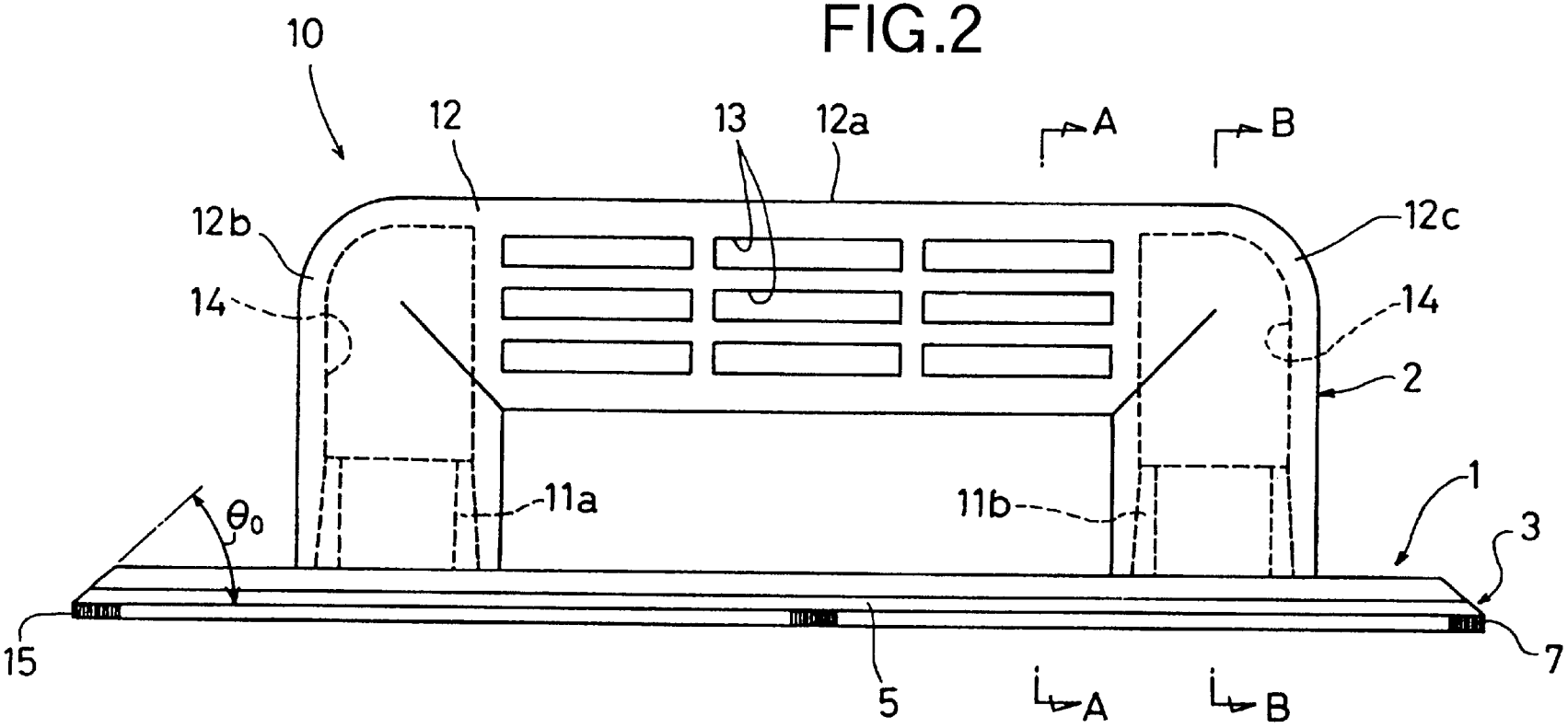
FIG. 2 is a side view of the cleaning brush shown in FIG. 1.
Figure 3:
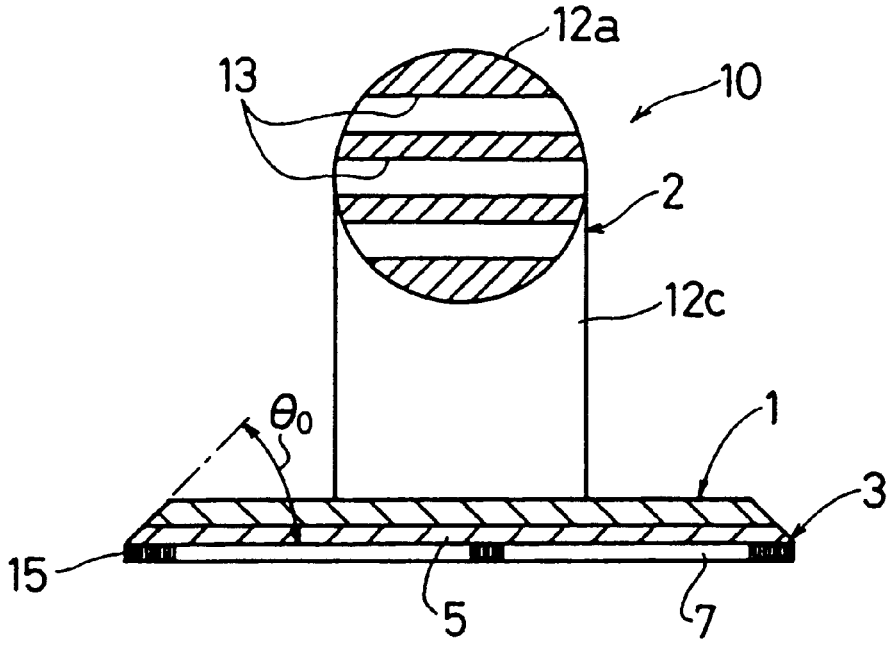
FIG. 3 is a sectional view taken along the line A—A on FIG. 2.
Figure 4:
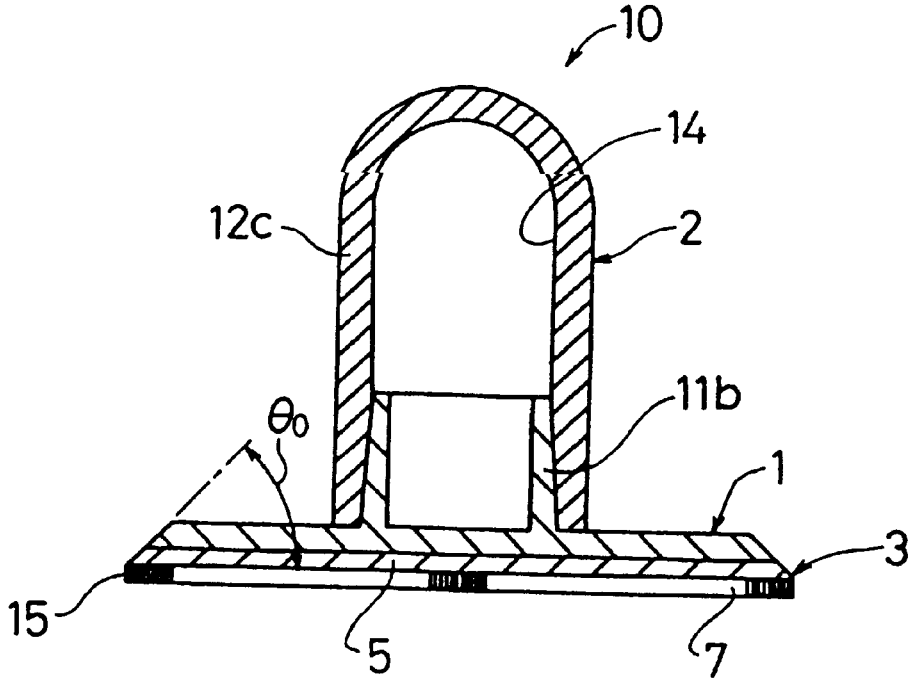
FIG. 4 is a sectional view taken along the line B—B on FIG. 2.

Formed in the grip portion 12*a* are many slots 13, for example, forming, at regular intervals, three lines in the vertical direction of the grip portion 12*a*, each comprising three slots in the axial direction of the grip portion 12*a*, which is perpendicular to the vertical direction. The slots 13 are provided to make the cleaning brush 10 lighter, or to attach a hereinafter described attachment thereto, so that the number and the arrangement of the slots 13 are not limited to the cases illustrated in FIGS. 2 and 3 but can be selected arbitrarily. Further, the diameter and the length of the grip portion 12*a* according to the first embodiment shown in FIGS. 2 and 3 are about 28 mm and about 85 mm, respectively, but can arbitrarily vary within the range of easily gripping with the hand. From the usableness viewpoint, the former may be 15–40 mm and the latter may be 50–150 mm. Further, the distance between the grip portion 12*a* and the mounting base 1 according to the first embodiment is about 22 mm but, from the usableness viewpoint, may be 15–40 mm. The grip portion 12*a* according to the first embodiment extends along the line passing the center of the width of and in parallel with the upper surface of the mounting base 1 but it is not always required. For example, it does not concern if the grip portion 12*a* extends along the line passing the center of the width of the upper surface of the mounting base 1 but is inclined in some degree to the upper surface of the mounting base 1, or if the grip portion 12*a* of the simple-beam type (the grip portion 12*a* rests on the support portion 12*b*, 12*c* at each end thereof) is changed to one of the cantilever tye. The boss portion 11*a*, 11*b* according to the first embodiment is of substantially cylindrical shape but is not always required. That is, if the grip portion 12*a* can surely be attached to the mounting base 1, any other constitution will do. To attach the handle 12 to the mounting base 1, the boss portion 11*a*, 11*b* is not always required. That is, the handle 12 may be formed integrally with the mounting base 1.

Figure 5A:
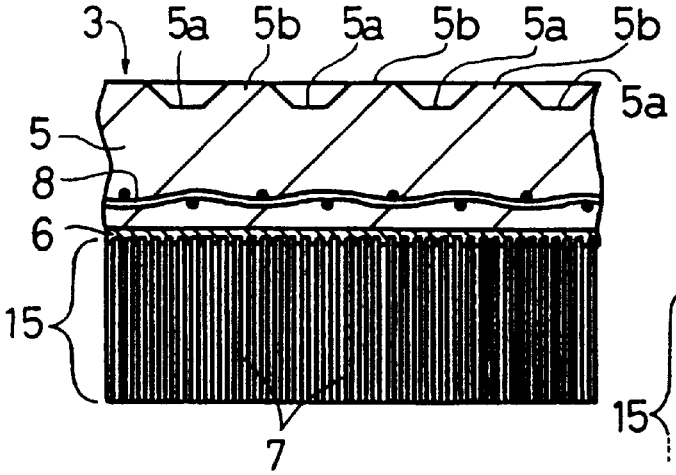
FIG. 5(A) is a longitudinal sectional view of a part of the planting portion of the cleaning brush shown in FIG. 1.
Figure 5B:
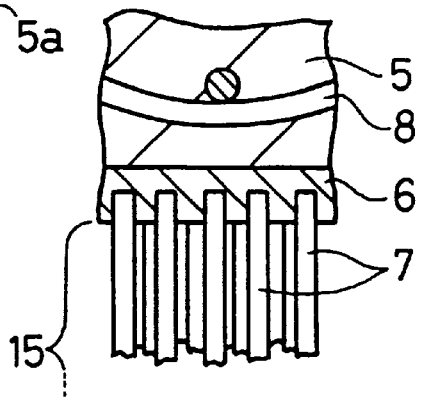
FIG. 5(B) is an enlarged longitudinal sectional view of a part of the planting portion shown in FIG. 5(A)

The planting portion 3 comprises, as plainly shown in FIGS. 5(A) and 5(B), a cushion layer or a backing layer 5, the upper surface of which is adhered to the flat lower surface of the mounting base 1 with a suitable adhesive such as a rubber adhesive or the like; a reinforcement net 8 made of glass fiber or other suitable net material and embedded in the backing layer 5 near the lower portion thereof; a fixing layer 6 made of suitable adhesive and provided on the substantially flat lower surface of the backing layer 5; and a multiplicity of fibers 7, the lower ends of which are embedded in the fixing layer 6 by means of planting them one by one in an upright state and fixing them, and the remaining portion of which are free and substantially vertically extend downwards. Thus, on the fixing layer 6, a pile layer 15 having a substantially uniform thickness all over is formed by the parts of the fibers 7 not to be embedded. The reinforcement net 8 according to the first embodiment has a group of substantially rectangular openings put side by side, each opening having an area of about 4 mm×about 5 mm, and functions so as to reinforce the backing layer 5 and to restrain the expansion, contraction, and bend of the backing layer 5. In order to plant the multiplicity of fibers 7 in the lower surface of the backing layer 5, an adhesive is applied to the lower surface of the backing layer 5 so as to form the fixing layer 6 and, before the adhesive is cured, the multiplicity of fibers 7 are made to catch at their one ends with the adhesive by the help of the electrostatic interaction. When the adhesive is cured, the fixing layer 6 is formed.

The backing layer 5 may be made of compound (that is, molding composition) having elasticity and waterproofness, such as polyvinyl chloride (PVC), polyurethane resin, ethylene-propylene copolymer, synthetic rubber or the like but, from the good productivity viewpoint, PVC-compound is particularly preferable. The Shore hardness of the backing layer 5 made of PVC-compound according to the first embodiment is about 50 but, from the usableness and cleaning-effect viewpoints, it is usually preferable to 40–80. It is much preferable to 45–60. The thickness of the backing layer 5 according to the first embodiment is about 1.9 mm but, from the usableness and cleaning-effect viewpoints, it is usually preferable to 0.5–5 mm. It is much preferable to 1–3 mm.

In the upper surface of the backing layer 5, a lot of depressed portions 5*a* may be formed side by side, for example, by means of embossing finish of the flat surface. The depressed portion 5*a* according to the first embodiment is shaped into a regular quadrangular truncated pyramid but it may be shaped into a substantially circular truncated cone, any of the various quadrangular truncated pyramids or other arbitrary shape. Further, the upper surface of the backing layer 5 may be made irregularly rugged. According to the first embodiment, the top surface of the regular quadrangular truncated pyramid (the bottom surface of the depressed portion 5*a*) has an area of about 1.5 mm×about 1.5 mm, the bottom surface of the pyramid (the edge of the depressed portion 5*a*) has an area of about 4 mm×about 4 mm, the depth of the depressed portion 5*a* is about 0.1 mm, and the pitch of the depressed portion 5*a* is about 6 mm both along its length and along its width. From the strength, good productivity and usableness viewpoints, it is preferable that the bottom surface of the arbitrarily shaped depressed portion 5*a* usually has an area of 1–25 $mm^2$ and it is much preferable to 2–20 $mm^2$. The area of the edge of the depressed portion 5*a* is usually preferable to 8–200 $mm^2$ and much preferable to 4–100 $mm^2$. The depth of the depressed portion 5*a* is usually preferable to 0.2–2.0 mm and much preferable to 0.4–1.2 mm. Further, the pitch of the depressed portion 5*a* is usually preferable to 1–20 mm both along its length and its width and much preferable to 2.5–12 mm.

In the upper surface of the backing layer 5, there are many depressed portions 5*a* put side by side as described above, so that lattice-like protruberant portions 5*b* are formed in the upper surface. When the lattice-like protruberant portions 5*b* are adhered to the lower surface of the mounting base 1 with a suitable adhesive, the upper surface of the backing layer 5 is fixed to the lower surface of the mounting base 1.

The fiber 7 may comprise monofilament of resin or the like, which has suitable elasticity and rigidity, such as nylon (nylon 6,6, nylon 6, nylon 6,10, or the like), polypropylene resin, polyethylene resin, polyvinyl chloride resin, polyvinylidene chloride resin, or the like but, from the cleaning-effect viewpoint, the fiber 7 of nylon such as nylon 6,6, nylon 6, nylon 6,10 or the like is preferable and the fiber 7 of nylon 6,6 is particularly preferable. The elastic modulus of nylon 6,6 is about 28,100 $kg/cm^2$ when tested by ASTM, D638-52T but, in order to make the fiber 7 have suitable elasticity and rigidity, the elastic modulus of the fiber 7 is usually preferable to 13,000–38,000 $kg/cm^2$, from the cleaning-effect and usableness viewpoints, and much preferable to 18,000–30,000 $kg/cm^2$. The fineness of the fiber 7 of nylon 6,6 according to the first embodiment may be about 15 denier or about 20 denier but, from the cleaning-effect and usableness viewpoints, it is usually preferable to 5–50 denier. Further, it is much preferable to 10–30 denier. The length of the fiber 7 according to the first embodiment is about 2.2 mm but, from the cleaning-effect and usableness viewpoints, it is usually preferable to 1.0–8.0 mm. Further, it is much preferable to 1.5–4.0 mm.

The planting density of the multiplicity of fibers 7 to the fixing layer 6 (in other words, the planting density of the pile layer 15) according to the first embodiment may be about 6,800 or about 8,000 filaments per $cm^2$ but, from the cleaning-effect and usableness viewpoints, it is usually preferable to 1,000–50,000 filaments/$cm^2$. Further, it is much preferable to 4,000–14,000 filaments/$cm^2$. The length of the part of tae fiber 7, which is embedded in the fixing layer 6 (that is, the remaining part except the pile layer 15) according to the first embodiment is about 0.1 mm but, from the cleaning-effect and usableness viewpoints, it is usually preferable to 0.02–1.0 mm. Further, it is much preferable to 0.05–0.5 mm. Therefore, the length of the free end of the fiber 7, which is not embedded in the fixing layer 6 (that is, the thickness of the pile layer 15) according to the first embodiment is about 2.1 mm but, from the cleaning-effect and usableness viewpoints, it is usually preferable to 0.8–7.8 mm. Further, it is much preferable to 1.3–3.8 mm. The ratio between the length of the fiber 7 except the part of pile layer 15 and the thickness of pile layer 15 according to the first embodiment is about 1:21 but, from the strength viewpoint, it is usually preferable to 1:5 to 1:80. Further, it is much preferable to 1:10 to 1:50.

In the first embodiment, as plainly shown in FIGS. 1–4, the pile layer 15 is formed by means of planting the filaments in the almost all the substantially flat lower surface of the backing layer 5, and all the outer periphery of the backing layer 5 and mounting base 1 has an inclination at $\theta_0$ starting at the lower end of the backing layer 5 and slanting substantially straightly inwards to the upper end of the mounting base 1. The inclination angle $\theta_0$ according to the first embodiment is about 45 degrees in case of both the backing layer 5 and the mounting base 1 but, from the cleaning-effect and usableness viewpoints, it is usually preferable to 25–75°. Further it is much preferable to 30–60°. The effect of the backing layer 5 and the mounting base 1 having the inclination angle $\theta_0$ will become apparent from the explanation of "how to use" hereinafter described.

Thus, the shape of the lower surface of the pile layer 15 (that is, the shape of the free end of the bundle formed out of the multiplicity of fibers 7) is substantially the same as that of the lower surface of the mounting base 1, which is of substantially isogonal-trapezoidal shape and longer in the longitudinal direction, but the lower surface of the pile layer 15 is a size larger (in other words, a little larger) than the lower surface of the mounting base 1. Similarly as described hereinafter with regard to FIG. 9(B), the shape of the lower surface of the pile layer 15 may be substantially the same as those of the upper surface and the lower surface of the backing layer 5 and the lower surface of the mounting base 1 and, without giving any inclination, the upper surface and the lower surface of the mounting base 1 (in other words, the lower surface of the pile layer 15) may be substantially the same in shape.

Figure 6:
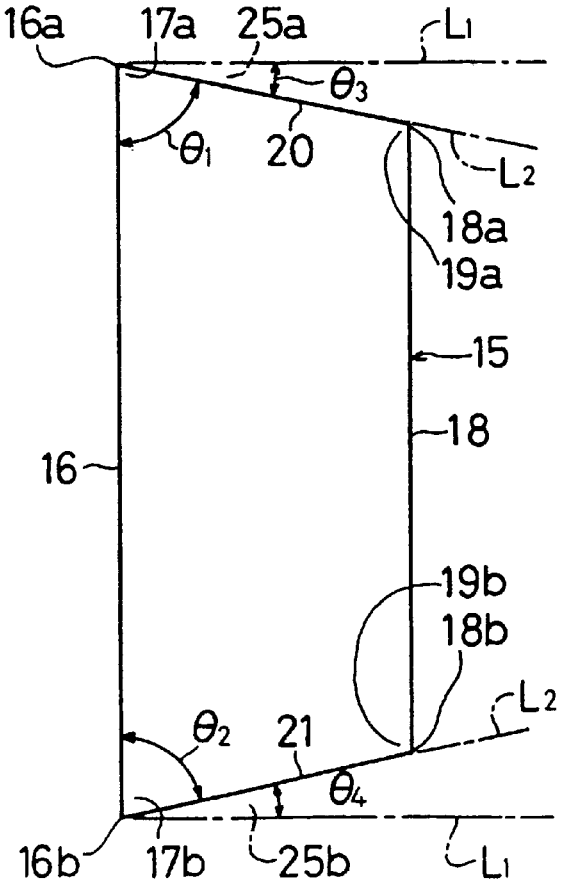
FIG. 6 is a schematic bottom view of the cleaning brush shown in FIG. 1, illustrating the lower surface configuration of the pile layer thereof.

In the first embodiment, the lower surface of the pile layer 15 is of substantially isogonal-trapezoidal shape as plainly shown in FIG. 6, so that a long-side edge 16, which is the lower base of the trapezoid, extends along the whole length of the pile layer 15, and has an acutely projecting portion 17*a*, 17*b* provided with an acute angle and lying near each end thereof. The lower surface of the pile layer 15 also has a short-side edge, which is the upper base of the trapezoid, extends in opposed relation to and substantially in parallel with the long-side edge and it has an obtusely projecting portion 19*a*, 19*b* provided with an obtuse angle and lying near each end thereof. As you will see, the lower surface of the pile layer 15 has the remaining two sides, that is, the pair of intermediate-side edges 20, 21 of the isogonal trapezoid, which lie between the distal ends 16*a* and 18*a*, 16*b* and 18*b*, respectively.

In the lower surface of the pile layer 15 shown in FIG. 6, the length of the long-side edge 16 according to the first embodiment is about 19 cm but, from the usableness viewpoint, it is usually preferable to 12–35 mm. Further, it is much preferable to 15–28 cm. The length of the short-side edge 18 according to the first embodiment is about 16 cm but, from the usableness viewpoint, it is usually preferable to 9–30 cm. Further, it is much preferable to 12–24 cm. The distance between the long-side edge 16 and the short-side edge 18 (that is, the maximum width of the pile layer 15 which is the height of the isogonal trapezoid) according to the first embodiment is about 7 cm but, from the usableness viewpoint, it is usually preferable to 4–15 cm. Further, it is much preferable to 5–10 cm. The ratio between the length of the pile layer 15 measured in the vertical direction in FIG. 6, which corresponds to the length of the long-side edge 16, and the maximum width of the pile layer 15, which corresponds to the height of the trapezoid, according to the first embodiment is about 2.7 but, from the usableness viewpoint, it is usually preferable to 1.5–5.0. Further, it is much preferable to 2.0–4.0.

Moreover, in the lower surface of the pile layer 15 shown in FIG. 6, the acute angles $\theta_1$, $\theta_2$ of the acutely projecting portions 17*a*, 17*b* according to the first embodiment are about 78 degrees but, from the usableness viewpoint, it is usually preferable to 50–86°. Further, it is much preferable to 65–82°. It is not always required that the acute angles $\theta_1$ and $\theta_2$ are the sane. Further, in the lower surface of the pile layer 15, acute angle $\theta_3$, $\theta_4$ is formed by a first imaginary line $L_1$ passing through each distal end 16*a*, 16*b* of and extending perpendicular to the long side edge 16, and a second imaginary line $L_2$ passing through each distal end 16*a*, 16*b* and forming an angle of 12° inwards (that is, on the pile layer side) with the first imaginary line $L_1$, and the space provided with the acute angle $\theta_3$, $\theta_4$ forms a free space 25*a*, 25*b* in which there is nothing of the planting portion 3 such as the pile layer 15 and others, the mounting base 1, and the handle portion 2. In the lower surface of the pile layer 15, the acute angle $\theta_3$, $\theta_4$ formed by the first imaginary line L1 and the second imaginary line $L_2$, according to the first embodiment, is about 12° but, from the usableness viewpoint, it is usually preferable to 4–40°. Further, it is much preferable to 8–25°. It is not always required that the acute angle $\theta_3$ and $\theta_4$ are the same. Further, the effect of the free space 25*a*, 25*b* provided with the acute angle $\theta_3$, $\theta_4$ will become apparent from the explanation of "how to use" hereinafter described.

In the first embodiment, it is not always required that the lower surface of the pile layer 15 is of substantially isogonal trapezoidal shape as shown in FIGS. 1 and 6. It may be of other trapezoidal, substantially rectangular, other arbitrarily polygonal or substantially circular shape. However, it is preferable that the shape of the lower surface of the pile layer 15 fulfills the following conditions as it will become substantially apparent from the explanation of "how to use" hereinafter described:

(1) the long-side edge 16 is substantially a straight line extending along the whole length of the pile layer 15, (2) the acutely projecting portions 17*a*, 17*b* lie near the both ends of the long-side edge 16, respectively, and (3) the space bounded by the first imaginary line $L_1$ and the second imaginary line $L_2$ forms the free space 25*a*, 25*b*.

Figure 7:
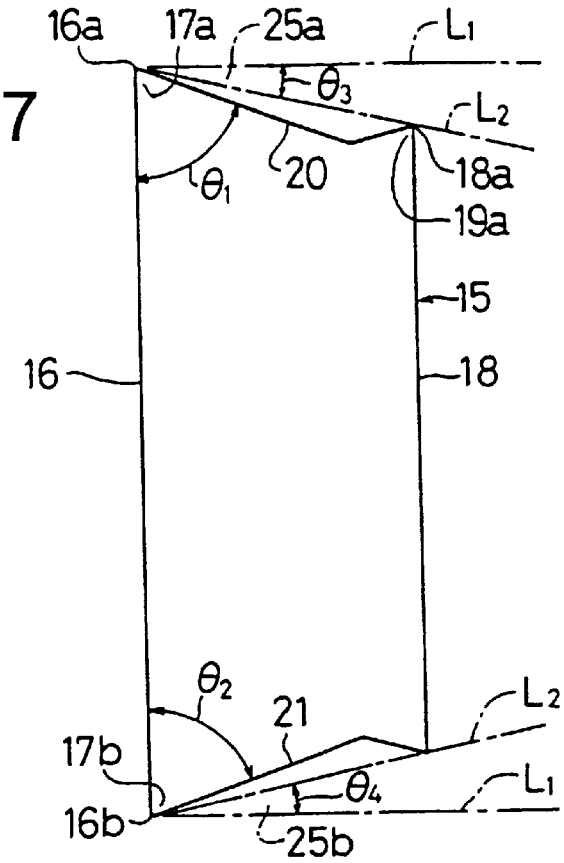
FIG. 7 is a schematic bottom view of the cleaning brush shown in FIG. 6, illustrating a modification of the lower surface configuration of the pile layer thereof.

So far as the shape of the lower surface of the pile layer 15 fulfills the above conditions (1)–(3), the shape may be selected arbitrarily other than the isogonal trapezoid. For example, as shown in FIG. 7 illustrating a modification of the lower surface shown in FIG. 6, the intermediate-side edge 20, 21 is a flat substantially-V-shaped broken line. Further, the intermediate-side edge 20, 21 may be of inwards convex circular shape. The short-side edge 18 may not be parallel to the long-side edge 16, or may be of curved shape. It is noted that, in FIG. 7, the same reference numerals are used for the common portions with those shown in FIG. 6, but the acute angle $\theta_1$, $\theta_2$ shown in FIG. 7 is about 70 degrees and smaller than that shown in FIG. 6. The preferable ranges of the length of the long-side edge 16, the maximum width of the pile layer 15, the ratio between the long-side edge 16 and the maximum width of the pile layer 15, and the magnitude of angles $\theta_1$–$\theta_4$ with regard to the shape of the lower surface of the pile layer 15 shown in FIG. 6 are applicable to the shape of the lower surface of the pile layer 15 shown in FIG. 7. Further, when the intermediate-side edge 20, 21 is of circular shape as described above, the above-described preferable range of the magnitude of the acute angle $\theta_1$, $\theta_2$ is applicable to the acute angle θ1, $\theta_2$ lying near each end 16*a*, 16*b*.

Subsequently, how to use the cleaning brush according to the first embodiment of this invention will be described. When the surface (to be cleaned), such as the outer wall, the inner wall, the window pane, the floor, the ceiling, the carpet or the like of the building or the ordinary house is cleaned by the use of the cleaning brush 10 according to the first embodiment, the pile layer 15 of the cleaning brush 10 is, firstly, impregnated with a liquid detergent on the market or not. In that event, the planting density of the pile layer 15 is high, so that the liquid detergent is surely kept in the pile layer 15 due to the capillary action of the capillary tubes formed by gaps in the multiplicity of fibers 7 planted in high density, so that it does not occur for the detergent to fall down unexpectedly from the pile layer 15. As tile liquid detergent, neutral detergent and bio-detergent are usable and, also, powder detergent is usable.

Subsequently, after grasping the handle 12 of the handle portion 2 with the hand and making the lower surface of the pile layer 15 abut on the surface (to be cleaned), all the cleaning brush 10 is reciprocated one to several times by means of reciprocating the hand. As a result of the foregoing, the lower ends of the multiplicity of fibers 7 have slipping contact with the surface (to be cleaned), so that it is possible to clean the surface easily, surely and thoroughly. Particularly, since both the fiber 7 and the backing layer 5 have suitable elasticity and, further, the fiber 7 is moderately thin and has suitable bending rigidity, the fiber 7 can surely get in narrow grooves and small pits of the surface (to be cleaned), so that the surface is surely cleaned without any unclear portion.

When there is no obstacle around the surface (to be cleaned), it is very easy to move the cleaning brush 10 both vertically and laterally in FIG. 1 to clean the surface. However, in the surface (to be cleaned), when there is a corner portion like a window pare or a corner of the bath room or the toilet room, or an obstacle like a window pane or a side wall, it is required that the cleaning work is conducted as plainly shown in FIGS. 8(A) and 8(B).

Figure 8A:
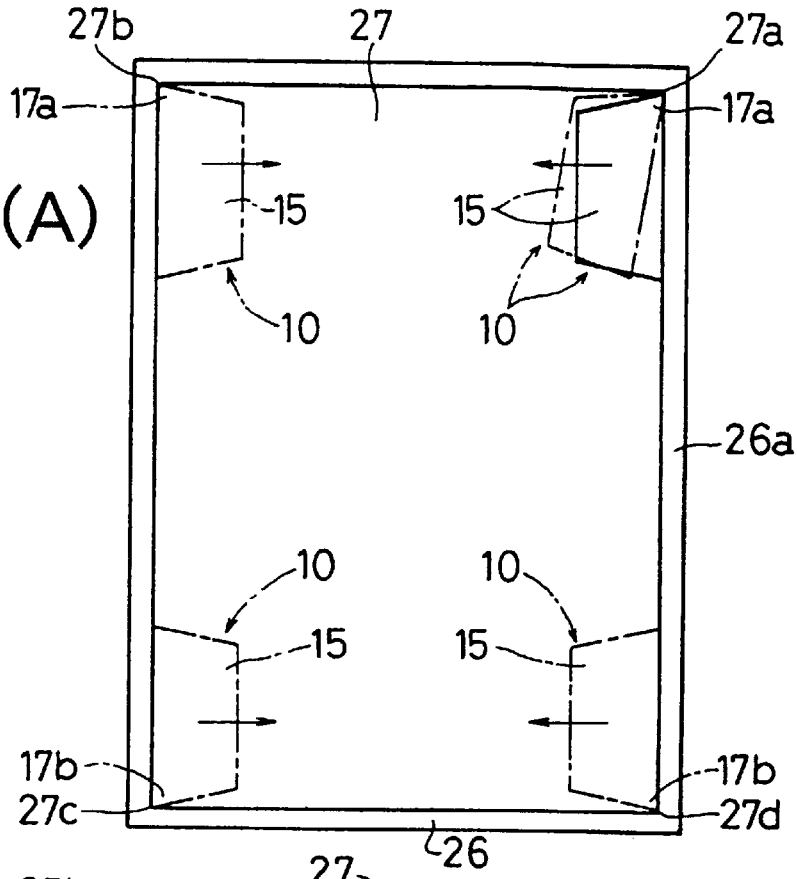
FIG. 8(A) is a schematic front view of a windowpane, in a first condition of cleaning the glass fitted in the frame with the cleaning brush shown in FIG. 1.
Figure 8B:
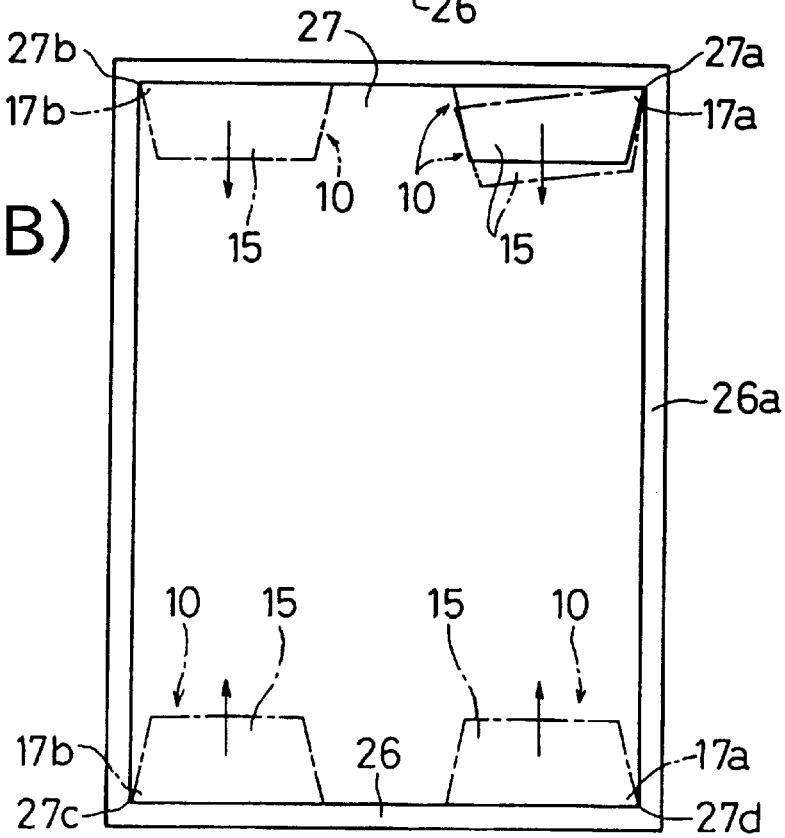
FIG. 8(B) is a view similar to FIG. 8(A), in a second condition of cleaning the glass fitted in the frame with the cleaning brush shown in FIG. 1.

That is, in FIGS. 8(A) and 8(B) which illustrate the positional relationship between the pile layer 15 of the cleaning brush 10 according to the first embodiment, and the window pane, the window frame being denoted by 26 protrudes from the window glass 27 (to be cleaned). In that event, when the right upper corner 27*a* of the window glass 27 is cleaned by the help of the cleaning brush according to the first embodiment, one of the acutely projecting portions 17*a* of the pile layer 15 is plunged into the right upper corner 27*a* to bring the pile layer 15 into a state of being indicated in chain line with one dot in the right upper part of FIG. 8(A). Then, if necessary, the cleaning brush 10 is moved to follow the illustrated arrow in the left direction, after the long-side edge 16 of the pile layer 15 is fitted with the inner edge of the right side part 26*a* of the window frame 26 as indicated in solid line in the right upper part of FIG. 8(A) and, if it is required, the cleaning brush 10 may be reciprocated in the lateral direction in FIG. 8(A) to clean the window glass 27.

As plainly shown in FIG. 6, in the lower surface of the pile layer 15, the acutely projecting portion 17*a* is provided with the acute angle $\theta_1$ and there is the hereinbefore described free space 25*a* adjacent to the intermediate-side edge 20, so that it is very easy to plunge the acutely projecting portion 17*a* into the right upper corner 27*a* of the window glass 27 and to position the distal end of the acutely projecting portion 17*a* in the tip of the right upper corner 27*a*. Further, if necessary, it is also very easy to surely fit the long-side edge 16 with the inner edge of the right side part 26*a* of the window frame 26.

Subsequently, as indicated in solid line in the right upper part of FIG. 8(B), the cleaning brush 10 is moved downwards, if it is required, to clean the right upper corner 27*a* of the window glass 27. In that event, the other acutely projecting portion 17*b* of the pile layer 15 may be plunged at first into the right upper corner 27*a* substantially in the same manner described above, which is indicated in chain line with one dot in the right upper part of FIG. 8(B). Also in case of cleaning the left upper corner 27*b*, the left lower corner 27*c*, and the right lower corner 27*d* of the window glass 27, one of the pair of acutely projecting portions 17*a*, 17*b* of the pile layer 15 is plunged into the corner 27*b*, 27*c* or 27*d* in the same manner described above, which is indicated in chain line with one dot in FIGS. 8(A) and 8(B).

In the cleaning brush 10 according to the first embodiment, the whole of the outer periphery of the backing layer 5 and mounting base 1 has an inclination starting at the lower end of the backing layer 5 and slanting at angle $\theta_0$ to the upper end of the mounting base 1, so that even if there is a packing of rubber or the like is provided along the inner edge of the window frame 26, it is very easy to surely plunge the distal end of the outer periphery of the pile layer 15 into the very narrow groove formed out of the edge of the packing, and the window frame 26 or the window glass 27. Further, it is very easy to surely plunge the distal end (that is, the lower end) of the outer periphery of the pile layer 15 (for example, one of the pair of intermediate-side edges 20, 21) also into ai very narrow groove, such as a very small gap between the lower end of the partition and the floor in the building, or a groove produced at each side of a gusset sewed on the sheet, for example, of the couch for the reception room. In addition, the angle $\theta_0$ of inclination is provided, so that, even if the distal end of the outer periphery of the pile layer 15 is plunged into the very narrow groove or the very small gap, it does not occur that the circumference of the groove or the gap is damaged by the mounting base 1 or the backing layer 5 of the cleaning brush 10.

Thus, if the cleaning brush 10 according to the first embodiment is used, it is very easy to clean the corner portion, the very narrow groove or the very narrow gap easily, surely and thoroughly without any unclear portion.

Moreover, the cleaning brush 10 according to the first embodiment is symmetrical in shape as plainly shown in FIGS. 1 and 2, so that it is possible to clean the gap or the groove from the one end thereof and, then, from the other end thereof, if one of the pair of intermediate-side edges 20 or 21 is plunged into the gap or the groove in a position adjacent to the one end thereof and moved toward the other end and, after the cleaning brush 10 is rotated in the horizontal plane through an angle of 180°, the other intermediate-side edge 21 or 20 is plunged into the gap or the groove in another position adjacent to the other end thereof. Further, not only the right-handed person, but also the left-handed person can use the cleaning bush 10 without feeling any inconvenience, because the left-handed person may grasp the handle 12 in the inverse state of the right-handed person doing.

When it is required to make the cleaning brush 10 according to the first embodiment reach an elevated spot, for example, at the time of cleaning the outer wall of the building, it is enough therefor if a bar or the like, one end of which an engaging device is provided, is used as an attachment. In that event, if claws that engage with the slots 13 provided in the grip portion 12*a* of the handle 12 of the handle portion 2 of the cleaning brash 10 are formed in the above engaging device, the cleaning brush 10 according to the first embodiment can be surely attached to the one end of the bar or the like, so that such a trouble that the bar is disengaged from the cleaning brush 10 while it is in use can be prevented.

Figure 9A:
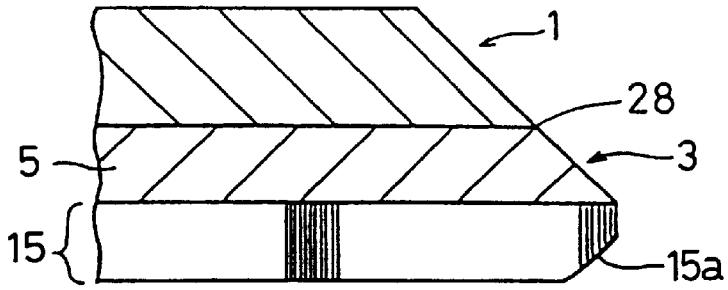
FIG. 9(A) is a longitudinal sectional view of a wear portion, caused by use, of the cleaning brush shown in FIG. 1.
Figure 9B:
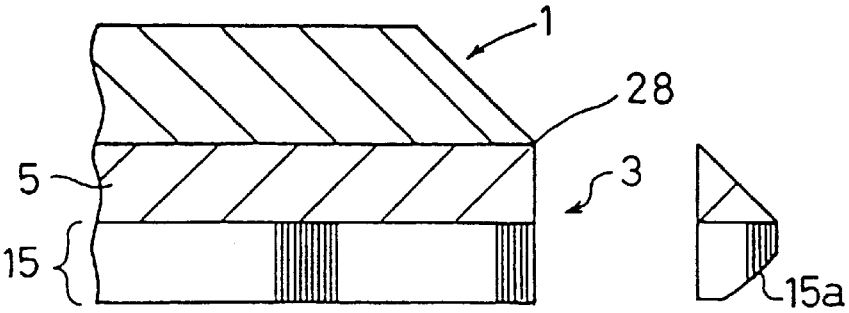
FIG. 9(B) is a view similar to FIG. 9(A), showing how to reform the wear portion shown in FIG. 9(A)

Moreover, in the cleaning brush 10 according to the first embodiment, when the planting portion 3, particularly the pile layer 15 wears in the outer periphery thereof, it is simply possible to reform the wear portion as plainly shown in FIGS. 9(A) and 9(B).

That is, in the cleaning brush 10 according to the first embodiment, the outer periphery of the pile layer 15 is apt to wear because the frequency in use of the outer periphery is high. From the explanation of "how to use" referring to FIGS. 8(A) and 8(B), it is apparent that the distal end of the acutely projecting portion 17*a*, 17*b* is particularly apt to wear, and easily has the wear portion 15*a* as plainly shown in FIG. 9(A), so that if the outer peripheries of the backing layer 5 and the pile layer 15, which are each of substantially isogonal-trapezoidal shape, are cut down, as plainly shown in FIG. 9(B), along a line of the substantially isogonal trapezoid 28 (FIG. 1), which forms a boundary between the mounting base 1 and the backing layer 5, it is possible to surely remove the wear portion 15*a*. In that event, if it is unnecessary for removing the wear portion 15*a* to cut down along the straight-line portion 28*a* of the line 28 that corresponds to the short-side edge 18 of the substantially isogonal trapezoid, the wear portion 15*a* may leave as it is.

Since the shape of the pile layer 15 and, sometimes, the shape of the backing layer 5 are reformed due to the removal of the wear portion 15*a*, the shape of the lower surface of the pile layer 15 becomes substantially equal, as described hereinbefore, to those of the upper surface and the lower surface of the backing layer 5, and the lower surface of the mounting base 1.

If the cleaning brush 10 according to the first embodiment is used, it is easy to surely clean not only the outer wall, the inner wall, the window glass, the floor, the ceiling, or the carpet of the building or the ordinary house, but also substantially all the surfaces (to be cleaned).

In the first embodiment, the multiplicity of fibers 7 are planted in the backing layer 5 provided in the planting portion 3 but, if the mounting base 1 is made of a compound having suitable elasticity and waterproofness like the backing layer 5, the multiplicity of fibers 7 may be planted directly in the lower surface of the mounting base 1 with an adhesive that is to constitute the fixing layer 6.

Moreover, in the first embodiment, the fiber 7 extends vertically downwards but, according to the use of the cleaning brush 10, the upper part of the fiber 7 may be embedded in the fixing layer 6 so that the fiber 7 may have slight inclination, for example, starting on the side of the short-side edge 18 and slanting to the side of the long-side edge 16. In that event, the friction of the lower surface of the pile layer 15 is larger in the direction to the side of the short-side edge 18 from the side of the long-side edge 16 than in the direction reverse thereof, so that it is possible to improve the cleaning effect of the cleaning brush 10 according to the first embodiment.

Moreover, in the first embodiment, all the outer peripheries of the backing layer 5 and the mounting base 1 have inclinations at angle $\theta_0$ but it is not always necessary that the short-side edges of the backing layer 5 and the mounting base 1, which correspond to the short-side edge 18, have such inclinations. If circumstances require, only the long-side edges of the backing layer 5 and the mounting base 1, which correspond to the long-side edge 16, may have such inclinations. Further, it is possible that the outer periphery of the mounting base 1 has no inclination, and all the outer periphery of the backing layer 5, all the outer periphery of the backing layer 5 except the short-side edge, or only the long-side edge has the inclination.

Moreover, in the first embodiment, the backing layer 5 and mounting base 1 have a smooth and straight inclination starting at the lower end of the backing layer 5 and slanting inwards to the upper end of the mounting base 1, but the inclination line may be not straightly but downwards or upwards convex (for example, (downwards or upwards circular-arc-like). If circumstances require, it may be stepped. When the inclination line is curved or so, as described above, the preferable range of the angle $\theta_0$ hereinbefore described is applied to the angle substantially at the lower end of the outer periphery of the backing layer 5.

When the cleaning brush 10 according to the first embodiment is used, the surface (to be cleaned) is easily and surely cleaned without any unclear portion, even when there is an obstacle around the surface, like the frame around the window glass, the corner portion of the bath room or the toilet room.

Furthermore, when the cleaning brush 10 is used, not only the surface (to be cleaned) is easily and surely cleaned without any unclean portion even when there is an obstacle like a corner portion around the surface, but also it is possible to improve both the strength and the endurance of the cleaning brush 10.

Moreover, when the cleaning brush 10 is used, it is possible to thoroughly clean a very soiled rough surface in a short period of time even if the irregularity of the surface is either small or rather large and, when the pile layer 15 is impregnated with a liquid detergent, it does not occur that the liquid detergent sprinkles anywhere in the vicinity of the pile layer 15.

Moreover, when the cleaning brush 10 is used, it is very easy to surely plunge the distal end of the outer periphery of the pile layer 15 into very narrow grooves or very narrow gaps, so that not only the corner portion of the surface (to be cleaned), but also the very narrow groove or the very narrow gap are thoroughly cleaned easily and surely without any unclean portion.

Referring to FIGS. 10–17, a cleaning brush according to a second embodiment of this invention will be described hereinafter.

Particularly as plainly shown in FIGS. 10–13, the cleaning brush 40 according to the second embodiment comprises a mounting base or a blockish grip portion 31, which is elastic and rich in softness and of substantially isogonal-trapezoidal prism-like shape, and a planting portion 33 attached to the lower surface of the blockish grip portion 31. It is noted that, in the second embodiment, the same numbers will be used with respect to such elements as to be common to those of the first embodiment, and the explanation thereof will be sometimes omitted.

The blockish grip portion 31 may be made of foamed soft resin, soft rubber or the like, being rich in elasticity and softness, and having waterproofness, such as foamed polyurethane, foamed polyolefin (foamed polyethylene, foamed polypropylene or the like), foamed rubber or the like, or the blockish grip portion 31 may be made of unfoamed material if circumstances require. From the strength and good productivity viewpoints, it is particularly preferable that the grip portion 1 is made of foamed polyurethane. The blockish grip portion 31 according to the second embodiment is about 40 mm in thickness (height) and is a block of substantially isogonal-trapezoidal prism-like shape. From the usableness viewpoint, the thickness of the blockish grip portion 31 is usually preferable to 3–100 mm and much preferable to 5–50 mm. The longitudinal elastic modulus of the blockish grip portion 31 according to the second embodiment is about 1.0 kg/cm$^2$ but, from the cleaning-effect viewpoint, it is usually preferable to 0.4–3.0 kg/cm$^2$. Further, it is much preferable to 0.6–1.8 kg/cm$^2$. The porosity of the blockish grip portion 31 according to the second embodiment is about 70% but, from the usableness and strength viewpoints, it is preferable to 45–95%. Further, it is much preferable to 55–85%.

Figure 12A:
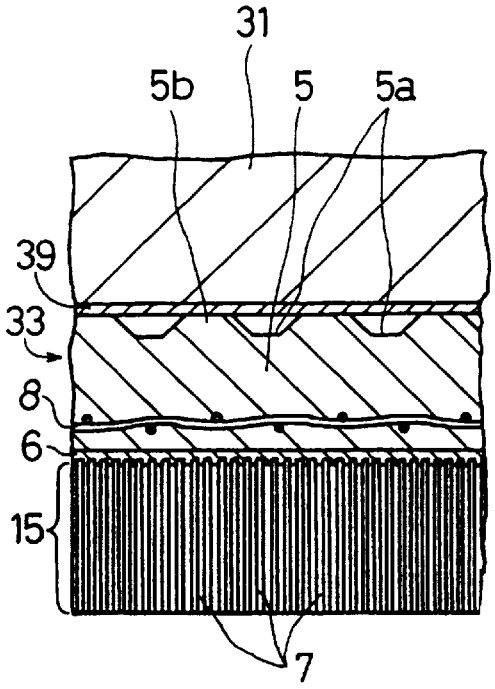
FIG. 12(A) is an enlarged longitudinal sectional view of a part of the brush portion of the cleaning brush shown in FIG. 10.
Figure 12B:
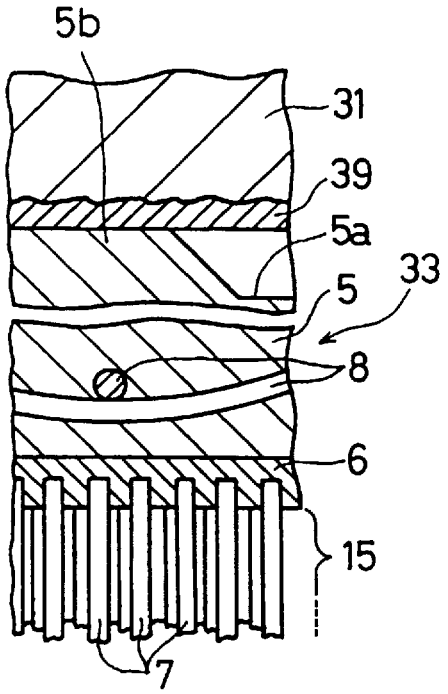
FIG. 12(B) is an enlarged detail view of a part of FIG. 12(A)

As plainly shown in FIGS. 12(A) and 12(B), the planting portion 33 comprises a flexible cushion layer or a flexible backing layer 5, the upper surface of which is adhered to the flat lower surface of the blockish grip portion 31 with a rubber adhesive or other suitable adhesive 39; a reinforcement net 8, which is made of glass fiber or other suitable net material and embedded in the backing layer 5 near the lower portion thereof; a fixing layer 6 made of suitable adhesive and provided on the substantially flat lower surface of the backing layer 5; and a multiplicity of fibers 7, the lower end of which are embedded in the fixing layer 6 by means of planting them one by one in an upright state and fixing them, and the remaining portion of which are free and substantially vertically extend downwards. Thus, on the fixing layer 6, a pile layer 15 having a substantially uniform thickness all over is formed by the parts of the fibers 7 not to be embedded. The reinforcement net 8 according to the second embodiment has a group of substantially rectangular openings put side by side, each opening having an area of about 4 mm×about 5 mm, and functions so as to reinforce the backing layer 5 and to restrain the expansion, contraction, and bend of the backing layer 5. In order to plant the multiplicity of fibers 7 in the lower surface of the backing layer 5, an adhesive is applied to the lower surface of the backing layer 5 so as to form the fixing layer 6 and, before the adhesive is cured, the multiplicity of fibers 7 are made to catch at their one ends with the adhesive by the help of the electrostatic interaction. When the adhesive is cured, the fixing layer 6 is formed.

The backing layer 5 may be made of compound (that is, molding composition) having suitable elasticity and suitable waterproofness, such as polyvinyl chloride (PVC), polyurethane resin, ethylene-propylene copolymer, synthetic rubber or the like but, from the good productivity viewpoint, PVC-compound is particularly preferable. The Shore hardness of the backing layer 5 made of PVC-compound, according to the second embodiment, is about 45 but, from the usableness and cleaning-effect viewpoints, it is usually preferable to 35–75. It is much preferable to 40–60. Thus, the material for the blockish grip portion 31 is softer than the material for the backing material 5. The thickness of the backing layer 5 according to the second embodiment is about 1.9 mm but, from the usableness and cleaning-effect viewpoints, it is usually preferable to 0.6–6.0 mm. It is much preferable to 1.0–4.0 mm.

In the upper surface of the backing layer 5, a lot of depressed portions 5*a* may be formed side by side, for example, by means of embossing finish of the flat surface. The depressed portion 5*a* according to the second embodiment is shaped into a substantially regular quadrangular truncated pyramid but it may be shaped into any truncated cone, such as a substantially circular truncated cone or a rectangular truncated pyramid. Further, the upper surface of the backing layer 5 may be made irregularly rugged. According to the second embodiment, the top surface of the regular quadrangular truncated pyramid (the bottom surface of the depressed portion 5*a*) has an area of about 1.5 mm×about 1.5 mm, the bottom surface of the pyramid (the edge of the depressed portion 5*a*) has an area of about 4 mm×about 4 mm, the depth of the depressed portion 5*a* is about 0.1 mm, and the pitch of the depressed portion 5*a* is about 6 mm both along its length and along its width. From the strength, good productivity and usableness viewpoints, it is preferable that the bottom surface of the arbitrarily shaped depressed portion 5*a* usually has an area 1–25 $mm^2$ and it is much preferable to 2–20 $mm^2$. The area of the edge of the depressed portion 5*a* is usually preferable to 8–200 $mm^2$ and much preferable to 4–100 $mm^2$. The depth of the depressed portion 5*a* is usually preferable to 0.2–2.0 mm and much preferable to 0.4–1.2 mm. Further, the pitch of the depressed portion 5*a* is usually preferable to 1–20 mm both along its length and its width and much preferable to 2.5–12 mm.

In the upper surface of the backing layer 5, there are many depressed portions 5*a* put side by side as described above, so that lattice-like protruberant portions 5*b* are formed in the upper surface. When the lattice-like protruberant portions 5*b* are adhered to the lower surface of the mounting base 31 with a suitable adhesive, the upper surface of the backing layer 5 is fixed to the lower surface of the mounting base 31.

The fiber 7 may comprise monofilament of resin or the like, which has suitable elasticity and suitable rigidity, such as nylon (nylon 6,6, nylon 6, nylon 6,10 or the like), polypropylene resin, polyethylene resin, polyvinyl chloride resin, polyvinylidene chloride resin, or the like but, from the cleaning-effect viewpoint, the fiber 7 of nylon, such as nylon 6,6, nylon 6, nylon 6,10 or the like is preferable and the fiber 7 of nylon 6,6 is particularly preferable. The elastic modulus of nylon 6,6 is about 28,100 $kg/cm^2$ when tested by ASTM, D638-52T but, in order to make the fiber 7 have suitable elasticity and suitable rigidity, the elastic modulus of the fiber 7 is usually preferable to 13,000–38,000 $kg/cm^2$, from the cleaning-effect and usableness viewpoints, and much preferable to 18,000–30,000 $kg/cm^2$. The fineness of the fiber 7 of nylon 6,6 according to the second embodiment may be about 15 denier or about 20 denier but, from the cleaning-effect and usableness viewpoints, it is usually preferable to 5–50 denier. Further, it is much preferable to 10–30 denier. The length of the fiber 7 according to the second embodiment is about 2.2 mm but, from the viewpoint of practical use, it is usually preferable to 1.0–8.0 mm. Further, it is much preferable to 1.5–4.0 mm.

The planting density of the multiplicity of fibers 7 to the fixing layer 6 (in other words, the planting density of the pile layer 15) according to the second embodiment may be about 6,800 or about 8,000 filaments per $cm^2$ but, from the cleaning-effect and usableness viewpoints, it is usually preferable to 1,000–50,000 filaments/$cm^2$. Further, it is much preferable to 4,000–14,000 filaments/$cm^2$. The length of the part of the fiber 7, which is embedded in the fixing layer 6 (that is, the remaining part except the pile layer 15) according to the second embodiment is about 0.1 mm but, from the cleaning-effect and usableness viewpoints, it is usually preferable to 0.02–1.0 mm. Further, it is much preferable to 0.05–0.5 mm. Therefore, the length of the free end of the fiber 7, which is not embedded in the fixing layer 6 (that is, the thickness of the pile layer 15) according to the second embodiment is about 2.1 mm but, from the cleaning-effect and usableness viewpoints, it is usually preferable to 0.8–7.8 mm. Further, it is much preferable to 1.3–3.8 mm. The ratio between the length of the fiber 7 except the part of pile layer 15 and the thickness of pile layer 15 according to the second embodiment is about 1:21 but, from the strength viewpoint, it is usually preferable to 1:5 to 1:80. Further, it is much preferable to 1:10 to 1:50.

Figure 10:
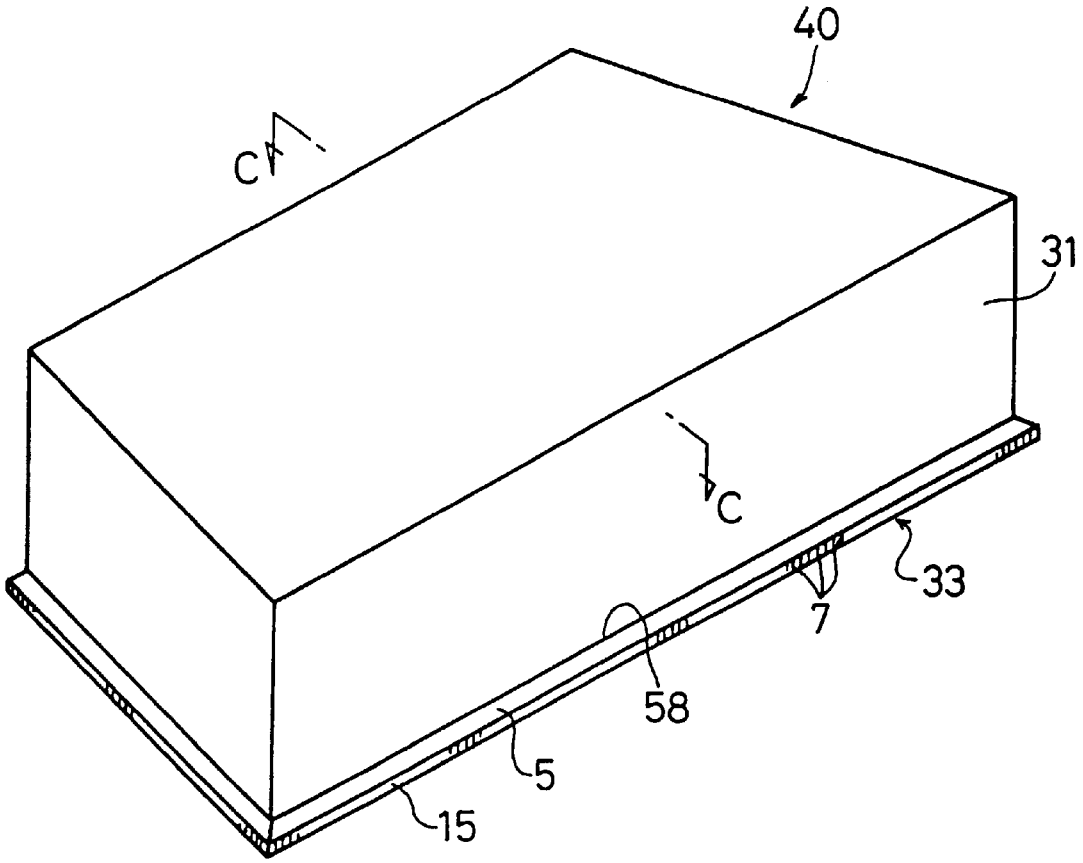
FIG. 10 is a plan view of a cleaning brush according to a second embodiment of this invention.
Figure 11:
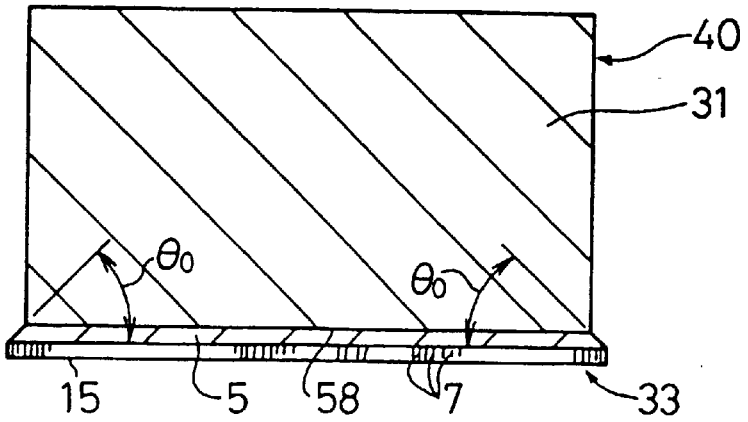
FIG. 11 is a sectional view taken along the line C—C on FIG. 10.

In the second embodiment, as plainly shown in FIGS. 10 and 11, the pile layer 15 is formed by means of planting the filaments in the almost all the substantially flat lower surface of the backing layer 5, and all the outer periphery of the backing layer 5 has an inclination at angle $\theta_0$ starting at the lower end thereof and slanting substantially straightly inwards to the upper end thereof. The inclination angle $\theta_0$ of the backing layer 5 according to the second embodiment is about 45 degrees but, from the cleaning-effect and usableness viewpoints, it is usually preferable to 25–75°. Further it is much preferable to 30–60°. The effect of the backing layer 5 having the inclination angle $\theta_0$ will become apparent from the explanation of "how to use" hereinafter described.

Thus, the shape of the lower surface of the pile layer 15 (that is, the shape of the free end of the bundle formed out of the multiplicity of fibers 7) is substantially the same as that of the lower surface of the blockish grip portion 31, which is of substantially isogonal-trapezoidal shape, but the lower surface of the pile layer 15 is a size larger (in other words, a little larger) than the lower surface of the blockish grip portion 31. Similarly as hereinafter described with regard to FIG. 17(B), the shape of the lower surface of the pile layer 15 may be substantially the same as those of the upper surface and the lower surface of the backing layer 5 and the lower surface of the blockish grip portion 31.

Figure 13:
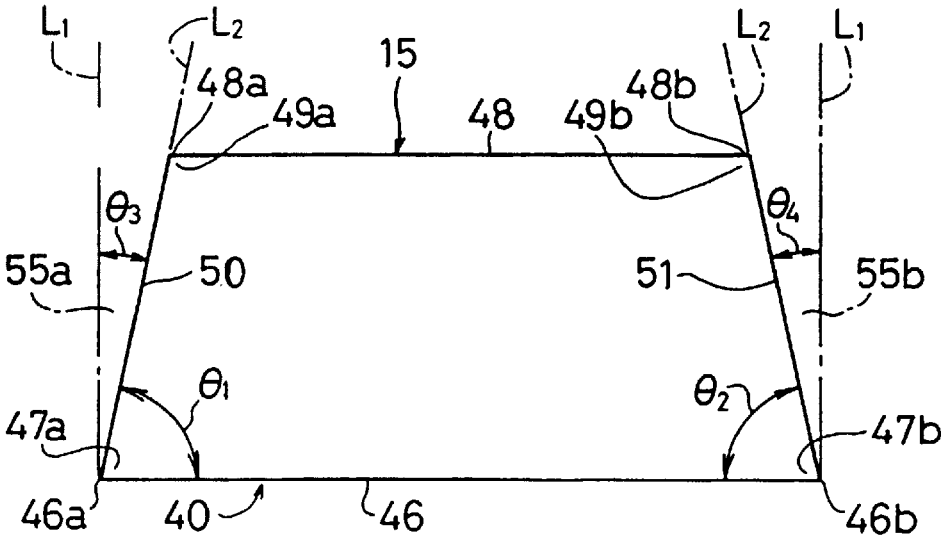
FIG. 13 is a schematic bottom view of the cleaning brush shown in FIG. 10, illustrating the lower surface configuration of the pile layer thereof.

In the second embodiment, the lower surface of the pile layer 15 is of substantially isogonal-trapezoidal shape as plainly shown in FIG. 13, so that a long-side edge 46, which is the lower base of the trapezoid, extends along the whole length of the pile layer 15, and has an acutely projecting portion 47*a*, 47*b* provided with an acute angle and lying near each end 46*a*, 46*b* of the long-side edge 46. The lower surface of the pile layer 15 also has a short-side edge 48, which is the upper base of the isogonal trapezoid extending in opposed relation to and substantially in parallel with the long-side edge 46 and, near to each end 48*a*, 48*b* of the short-side edge 48, there is an obtusely projecting portion 49*a*, 49*b* provided with ai obtuse angle. As you will see, the lower surface of the pile layer 15 has the remaining two sides, that is, the pair of intermediate-side edges 50, 51 of the isogonal trapezoid, which lie between the distal ends 46*a* and 48*a*, 46*b* and 48*b*, respectively.

In the lower surface of the pile layer 15 shown in FIG. 13, the length of the long-side edge 46 according to the second embodiment is about 15 cm but, from the usableness viewpoint, it is usually preferable to 6–30 cm. Further, it is much preferable to 10–20 cm. The length of the short-side edge 48 according to the second embodiment is about 12 cm but, from the usableness viewpoint, it is usually preferable to 4–24 cm. Further, it is much preferable to 8–16 cm. The distance between the long-side edge 46 and the short-side edge 48 (that is, the maximum width of the pile layer 15 which is the height of the isogonal trapezoid) according to the second embodiment is about 7 cm but, from the viewpoint of practical use, it is usually preferable to 4–15 cm. Further, it is much preferable to 5–10 cm. The ratio between the length of the pile layer 15 measured in the horizontal direction in FIG. 13, which corresponds to the length of the long-side edge 46, and the maximum width of the pile layer 15, which corresponds to the height of the trapezoid, according to the second embodiment, is about 2.1 but, from the usableness viewpoint, it is usually preferable to 1.0–5.0. Further, it is much preferable to 1.5–3.5.

Moreover, in the lower surface of the pile layer 15 shown in FIG. 13, the acute angles $\theta_1$, $\theta_2$ of the acutely projecting portions 47*a*, 47*b* according to the second embodiment are about 78 degrees but, from the usableness viewpoint, it is usually preferable to 50–86°. Further, it is much preferable to 65–82°. In here, it is not always required that the acute angles $\theta_1$ and $\theta_2$ are the same. Further, in the lower surface of the pile layer 15, the acute angle $\theta_3$, $\theta_4$ is formed by a first imaginary line $L_1$ passing through each distal end 46*a*, 46*b* of and extending perpendicular to the long-side edge 46, and a second imaginary line $L_2$ (a straight line overlying each intermediate-side edge 50, 51 in FIG. 13) passing through each distal end 46*a*, 46*b* and forming an angle of about 12° inwards (that is, on the pile layer side) with the first imaginary line $L_1$, and the space provided with the acute angle $\theta_2$, $\theta_4$ forms a free space 55*a*, 55*b* in which there is nothing of the planting portion 33 such as the pile layer 15 and others, and the blockish grip portion 31. In the lower surface of the pile layer 15, the acute angle $\theta_3$, $\theta_4$ formed by the first imaginary line $L_1$ and the second imaginary line $L_2$, according to the second embodiment, is about 12° but, from the usableness viewpoint, it is usually preferable to 4–40°. Further, it is much preferable to 8–25°. It is not always required that the acute angle $\theta_3$ and $\theta_4$ are the same. Further, the effect of the free space 55*a*, 55*b* provided with the acute angle $\theta_3$, $\theta_4$ will become apparent from the explanation of "how to use" hereinafter described.

It is not always required that the blockish grip portion 31 is of substantially isogonal-trapezoidal prism-like shape. It may be of quadrangular prism-like shape, substantially rectangular parallelopiped shape, cylindrical shape or other arbitrary blockish shape, so that it is not always required that the lower surface of the pile layer 15 is of substantially isogonal-trapezoidal shape as shown in FIGS. 10 and 13. The lower surface of the pile layer 15 may also be of trapezoidal shape, substantially rectangular shape, or other arbitrary shape, for example, circular shape or polygonal shape. However, it is preferable that the shape of the lower surface of the pile layer 15 fulfills the following conditions as it will become substantially apparent from the explanation of "how to use" hereinafter described:

(1) the long-side edge 46 is substantially a straight line extending along the whole length of the pile layer 15, (2) the acutely projecting portions 47*a*, 47*b* lie near the both ends of the long-side edge 46, respectively, and (3) the space bounded by the first imaginary line $L_1$ and the second imaginary line $L_2$ forms tae free space 55*a*, 55*b*.

Figure 14:
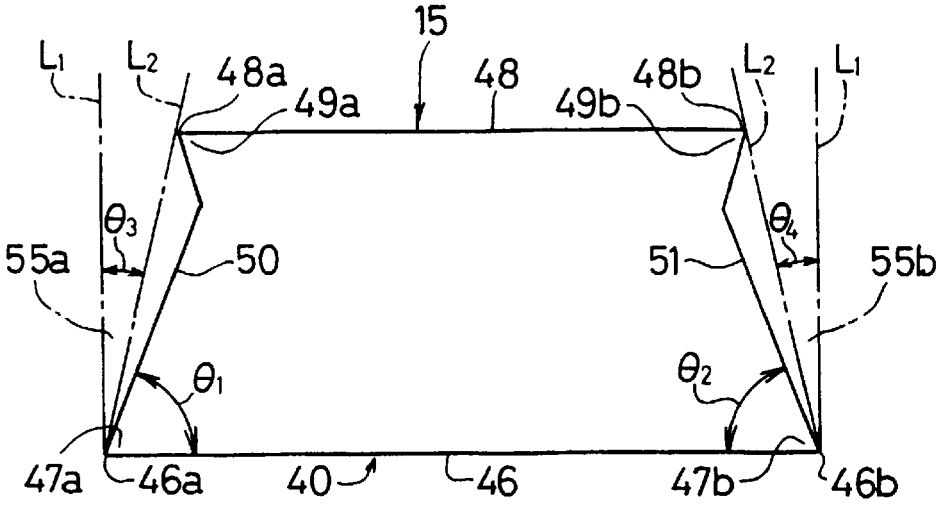
FIG. 14 is a schematic bottom view of the cleaning brush shown in FIG. 10, illustrating a modification of the lower surface configuration of the pile layer thereof.

So far as the shape of the lower surface of the pile layer 15 fulfills the above conditions (1)–(3), the shape may be selected arbitrarily other than the isogonal trapezoid. For example, as shown in FIG. 14 illustrating a modification of the lower surface shown in FIG. 13, the intermediate-side edge 50, 51 is a flat substantially-V-shaped broken line. Further, the intermediate-side edge 50, 51 may be of inwards convex circular shape. The short-side edge 48 may not be parallel to the long-side edge 46, or may be of curved shape. It is noted that, in FIG. 14, the same reference numerals are used for the common portions with those shown in FIG. 13, but the acute angle $\theta_1$, $\theta_2$ shown in FIG. 14 is about 70 degrees and smaller than that shown in FIG. 13. The preferable ranges of the length of the long-side edge 46, the maximum width of the pile layer 15, the ratio between the long-side edge 46 and the maximum width of the pile layer 15, and the magnitude of angles $\theta_1$–$\theta_4$ with regard to the shape of the lower surface of the pile layer 15 shown in FIG. 13 are applicable to the shape of the lower surface of the pile layer 15 shown in FIG. 14. Further, when the inter mediate-side edge 50, 51 is of circular shape as described above, the above-described preferable range of the magnitude of the acute angle $\theta_1$, $\theta_2$ is applicable to the acute angle $\theta_1$, $\theta_2$ lying near each end 46*a*, 46*b*.

Subsequently, how to use the cleaning brush according to the second embodiment of this invention will be described. When the surface (to be cleaned), such as the body of the motor car, the outer wall, the inner wall, the window pane, the floor, the ceiling or the carpet of the building or the ordinary house, the stool of the toilet room, or the lavatory sink, or the like is cleaned by the use of the cleaning brush 40 according to the second embodiment, the pile layer 15 of the cleaning brush 40 is, firstly, impregnated with a liquid detergent on the market or not. In that event, the planting density of the pile layer 15 is high, so that the liquid detergent is surely kept in the pile layer 15 due to the capillary action of the capillary tubes formed by gaps in the multiplicity of fibers 7 planted in high density. Therefore, it does not occur for the detergent to fall down unexpectedly from the pile layer 15. As the liquid detergent, neutral detergent and bio-detergent are usable and, also, powder detergent is usable.

Subsequently, after grasping the blockish grip portion 31 with the hand and making the lower surface of the pile layer 15 abut on the surface (to be cleaned), all the cleaning brush 40 is reciprocated one to several times by means of reciprocating the hand. As a result of the foregoing, the lower ends of the multiplicity of fibers 7 have slipping contact repeatedly with the surface (to be cleaned), so that it is possible to clean the surface easily, surely and thoroughly. Particularly, since both the fiber 7 and the backing layer 5 have suitable elasticity and, further, the fiber 7 is moderately the and has suitable bending rigidity, the fiber 7 can surely get in narrow grooves and small pits of the surface (to be cleaned), so that the surface is surely cleaned without any unclear portion.

Figure 15A:
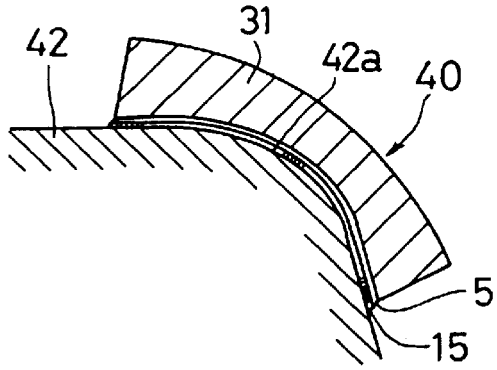
FIG. 15(A) is a sectional view of the cleaning brush shown in FIG. 10 in a condition of cleaning a convex surface (to be cleaned) therewith.
Figure 15B:
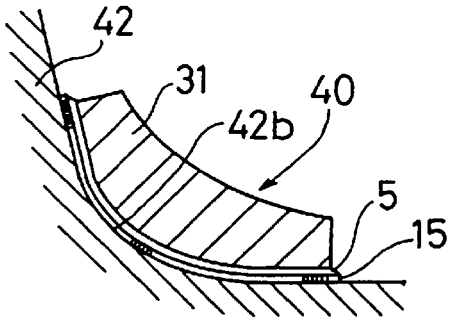
FIG. 15(B) is a view similar to FIG. 15(A), in a condition of cleaning a concave surface (to be cleaned) with the cleaning brush shown in FIG. 10.

The blockish grip portion 31 is rich in softness, so that it is very easy to grasp it. Further, not only the blockish grip portion 31 is rich in softness, but also the backing layer 5 is flexible, so that it is easy to make the lower surface of the pile layer 15 of the cleaning brush 40 have good contact with substantially all the convex surface 42*a* and concave surface 42*b* in the surface 42 (to be cleaned) as shown in FIGS. 15(A) and 15(B) even when there are convex portions and/or concave portions in the surface (to be cleaned). Thus, it is possible to clean the surface 42 (to be cleaned) easily, surely and thoroughly with the cleaning brush 40 even when there are convex surface 42*a* and/or the concave surface 42*b* in the surface 42.

When there is no obstacle around the surface (to be cleaned), it is very easy to move the cleaning brush 40 both vertically and laterally in FIG. 10 an clean the surface. However, when there is an obstacle around the surface (to be cleaned), for example, when the surface is a window glass fitted in the window frame, or a wall, crossing with a side wall, of the bathroom or the toilet room and, thereby, a corner portion is formed, it is required that the cleaning work is conducted as plainly shown in FIGS. 16(A) and 16(B).

Figure 16A:
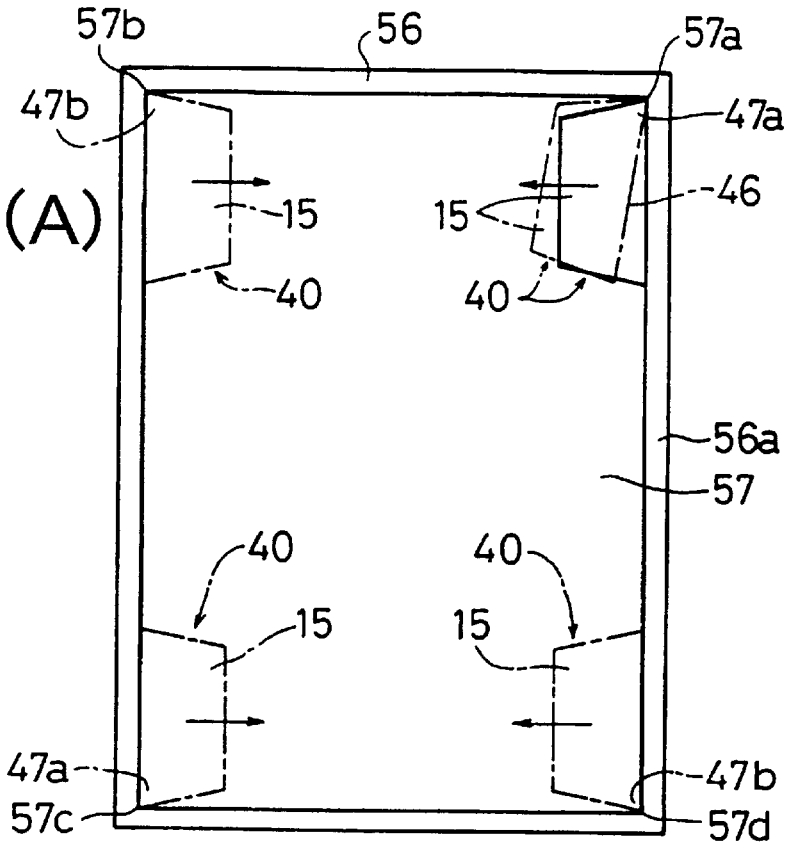
FIG. 16(A) is a schematic front view of a windowpane, in a first condition of cleaning the glass fitted in the frame with the cleaning brush shown in FIG. 10.
Figure 16B:
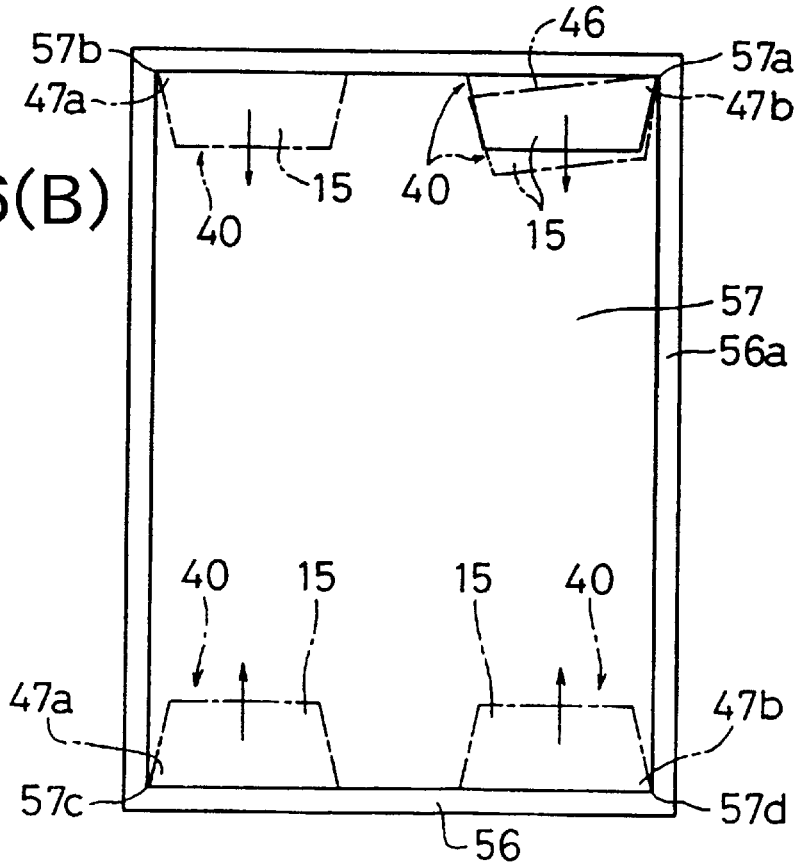
FIG. 16(B) is a view similar to FIG. 16(A), in a second condition of cleaning the glass fitted in the frame with the cleaning brush shown in FIG. 10.

That is, in FIGS. 16(A) and 16(B) illustrating the positional relationship between the pile layer 15 of the cleaning brush 40 according to the second embodiment, and the window glass 57 surrounded by the window frame 56, the window frame 56, in which the window glass 57 has been fitted, protrudes outwards from the surface of the window glass 57 (in the forward direction of the leaf) and th e window glass has convex portions and concave portions. In that event, when the right upper corner 57*a* of the window glass 57 is to be cleaned by the help of the cleaning brush 40 according to the second embodiment, one of the acutely projecting portions 47*a* of the pile layer 15 is plunged into the right upper corner 57*a* to bring the pile layer 15 into a state of being indicated in chain line with one dot in the right upper part of FIG. 16(A). Then, if necessary, the cleaning brush 40 is moved to follow the illustrated arrow in the left direction, after the long-side edge 46 of the pile layer 15 is fitted with the inner edge of the right side part 56*a* of the window frame 56 as indicated in solid line in the right upper part of FIG. 16(A) and, if it is required, the cleaning brush 40 may be reciprocated in the lateral direction in FIG. 16(A) to clean the window glass 57.

As plainly shown in FIG. 13, in the lower surface of the pile layer 15, the acutely projecting portion 47*a* is provided with the acute angle $\theta_1$ and there is the hereinbefore described free space 55*a* adjacent to the intermediate-side edge 50, so that it is very easy to plunge the acutely projecting portion 47*a* into the right upper corner 57*a* of the window glass 57 and to position the distal end of the acutely projecting portion 47*a* in the tip of the right upper corner 57*a*. Further, if necessary, it is also very easy to surely fit the long-side edge 46 with the inner edge of the right side part 56*a* of the window frame 56.

Subsequently, as indicated in sold line in the right upper part of FIG. 16(B), the cleaning brush 40 is moved downwards, if it is required, to clean the right upper corner 57*a* of the window glass 57. In that event, the other acutely projecting portion 47*b* of the pile layer 15 may be plunged at first into the right upper corner 57*a* substantially in the same manner described above, which is indicated in chain line with one dot in the right upper part of FIG. 16(B). Also in case of cleaning the left upper corner 57*b*, the left lower corner 57*c*, and the right lower corner 57*d* of the window glass 57, one of the pair of acutely projecting portions 47*a*, 47*b* of the pile layer 15 is plunged into the corner 57*b*, 57*c* or 57*d* in the same manner described above, which is indicated in chain line with one dot in FIGS. 16(A) and 16(B).

In the cleaning brush 40 according to the second embodiment, the whole of the outer peripheral of the backing layer 5 has an inclination in its thickness direction, starting at the lower end thereof and slanting at angle $\theta_0$ to the upper end thereof, so that even if there is a packing of rubber or the like is provided along the inner edge of the window frame 56, it is very easy to surely plunge the distal end of the outer periphery of the pile layer 15 into the very narrow groove formed out of the edge of the packing, the window frame 56 or the window glass 57. Further, it is very easy to surely plunge the distal end (that is, the lower end) of the outer periphery of the pile layer 15 (for example, one of the pair of intermediate-side edges 50, 51) also into a very narrow groove, such as a very small gap between the lower end of the partition and the floor in the building, or a groove produced at each side of a gusset sewed on the sheet, for example, of the couch for the reception room. In addition, since the angle $\theta_0$ of inclination is provided as described above, so that, even if the distal end of the outer periphery of the pile layer 15 is plunged into the very narrow groove or the very small gap, it does not occur that the circumference of the groove or the gap is damaged by the backing layer 53 of the cleaning brush 40.

Thus, if the cleaning brush 40 according to the second embodiment is used, the convex surface 42*a* and/or the concave surface 42*b* in the surface (to be cleaned) can be surely cleaned and, also, it is very easy to clean the corner portion, the very narrow groove or the very narrow gap easily, surely and thoroughly without any unclear portion.

Moreover, the cleaning brush 40 according to the second embodiment is symmetrical in shape as plainly shown in FIGS. 10 and 13, so that it is possible to clean the gap or the groove from the one end thereof and, then, from the other end thereof, if one of the pair of intermediate-side edges 50 or 51 is plunged into the gap or the groove in a position adjacent to the one end thereof and moved toward the other end and, after the cleaning brush 40 is rotated in the horizontal plane through an angle of 180°, the other intermediate-side edge 51 or 50 is plunged into the gap or the groove in another position adjacent to the other end thereof. Further, not only the right-handed person, but also the left-handed person can use the cleaning brush 40 without feeling any inconvenience, because the left-handed person may grasp the handle 31 in the inverse state of the right-handed person doing.

Figure 17A:
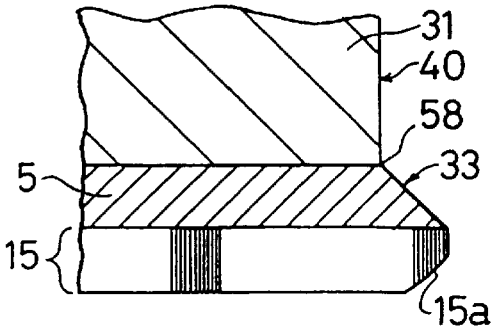
FIG. 17(A) is a longitudinal sectional view of a wear portion, caused by use, of the cleaning brush shown in FIG. 10.
Figure 17B:
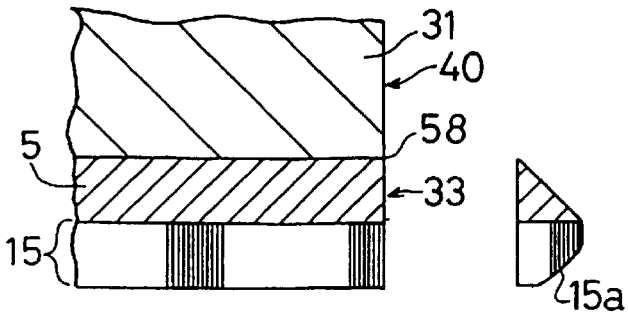
FIG. 17(B) is a view similar to FIG. 17(A), showing how to reform the wear portion shown in FIG. 17(A)

Moreover, in the cleaning brush 43 according to the second embodiment, when the planting portion 33, particularly the pile layer 15 wears in the outer periphery thereof, it is simply possible to reform the wear portion 15*a* as-plainly shown in FIGS. 17(A) and 17(B).

That is, in the cleaning brush 40 according to the second embodiment, the outer periphery of the pile layer 15 is apt to wear because the frequency in use of the outer periphery is high. From the explanation of "how to use" referring to FIGS. 16(A) and 16(B), it is apparent that the distal end of the acutely projecting portion 17*a*, 17*b* is particularly apt to wear, and easily has the wear portion 15*a* as plainly shown in FIG. 17(A), so that if the outer peripheries of the backing layer 5 and the pile layer 15 are cut down, as plainly shown in FIG. 17(B), along the substantially isogonal-trapezoidal line 58 (FIGS. 10 and 11) that forms a boundary between the blockish grip portion 31 and the backing layer 5, it is possible to surely remove the wear portion 15*a*. In that event, if it is unnecessary for removing the wear portion 15*a* to cut down along the straight line portion of the line 58 that corresponds to the short-side edge 48 of the substantially isogonal trapezoid, the wear portion 15*a* may leave as it is.

Thus, the shape of the pile layer 15 and, sometime, the shape of the backing layer 5 (an be reformed due to removal of the wear portion 15*a*, so chat the lower surface of the pile layer 15 becomes substantially the same in shape as the upper surface and the lower surface of the backing layer 5 and the lower surface of the blockish grip portion 31 as hereinbefore described.

If the cleaning brush 40 according to the second embodiment is used, it is easy to surely clean not only the body of the motor car, the outer wall, the inner wall, the window glass, the floor and the ceiling of the building or the ordinary house, the carpet, the stool in the toilet room, or the lavatory sink, but also substantially all the surfaces (to be cleaned).

In the second embodiment, all the outer periphery of the backing layer 5 has an inclination at angle $\theta_0$ but it is not always necessary that the short-side edge of the backing layer 5, corresponding to the short-side edge 48, has such an inclination. It can be constituted that only the long-side edge of the backing layer 5, corresponding to the long-side edge 46, has such an inclination. If circumstances require, all the outer periphery of the backing layer 5 may have no inclination.

Further, in the second embodiment, the inclination of angle $\theta_0$, given to the backing layer 5, extends substantially straightly, but the inclination may be formed of downwards convex or concave curve (for example, downwards or upwards circular-arc-like) and, sometimes, may be stepped. When the inclination is formed of curve or the like as described above, the preferable range, hereinbefore described, of the inclination angle $\theta_0$ is applied to the angle substantially at the lower end of the outer periphery of the backing layer 5.

Moreover, in the second embodiment, the fiber extends substantially vertically in the downward direction but, according to the use of the cleaning brush 40, the upper part of the fiber 7 may be embedded in the fixing layer 6 so that the fiber 7 may have slight inclination, for example, starting on the side of the short-side edge 48 and slanting to the side of the long-side edge 46. In that event, the friction of the lower surface of the pile layer 15 is larger in the direction to the side of the short-side edge 48 from the side of the long-side edge 46 than in the direction reverse thereof, so that it is possible to improve the cleaning effect of the cleaning brush 40 according to the second embodiment.

When the cleaning brush 40 according to the second embodiment is used, the surface (to be cleaned) can be easily, surely and thoroughly cleaned, even when there are convex surfaces 42*a* and/or concave surfaces 42*b* in the surface (to be cleaned) like the body of the motor car.

Furthermore, when the cleaning brush 40 according to the second embodiment is used, it is very easy to surely plunge the distal end of each monofilament of the pile layer 15 into very narrow grooves or very narrow gaps, so that also the very narrow grooves or gaps of the surface (to be cleaned) can be easily, surely and thoroughly cleaned without any unclean portion.

Moreover, when the cleaning brush 40 according to the second embodiment is used, it does not occur that the liquid detergent impregnated into the pile layer 15 sprinkles anywhere in the vicinity of the pile layer 15, and the planting portion 33 has very good strength and endurance.

Referring to FIGS. 18–21, a cleaning pad for the electrically rotated floor-polisher, according to a third embodiment of this invention will be described hereinafter.

Figure 18:
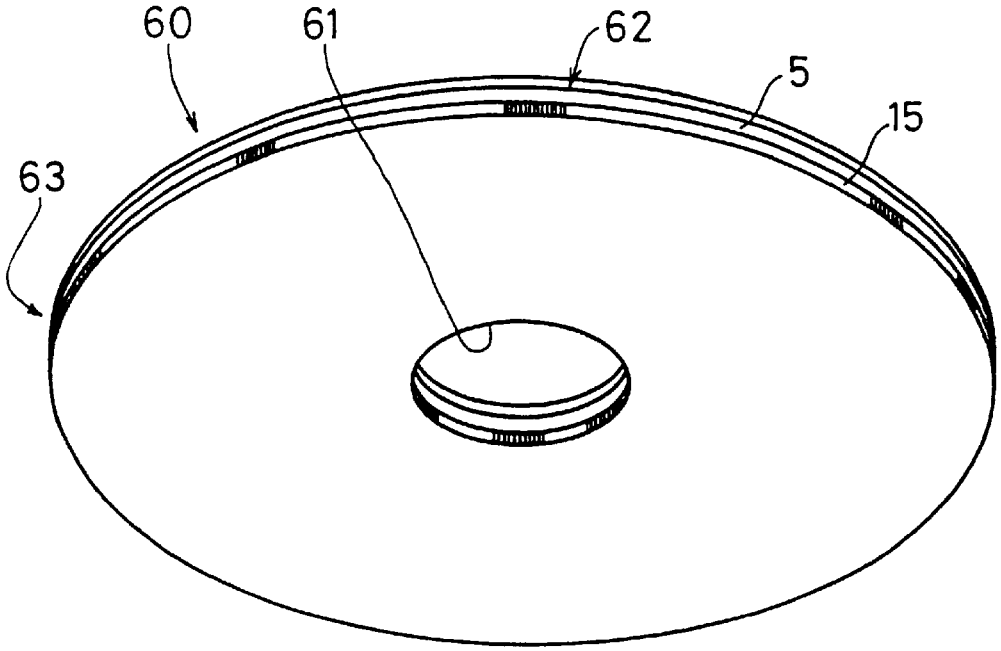
FIG. 18 is a perspective view of a cleaning pad for an electrically rotated floor-polisher according to a third embodiment of this invention.

Particularly as plainly shown in FIGS. 18 and 21, the cleaning pad (the so-called floor pad) 60 according to the third embodiment of this invention comprises a flexible and disklike attached portion 62, having a central opening 61 and being attachable to the driving pad of the electrically rotated floor-polisher, and a flexible and disklike planting portion 63 adhered to the lower surface of the attached portion 62 with a suitable adhesive 67. It is noted that, in the third embodiment, the same numbers will be used with respect to such elements as tc be common to those of the first embodiment, and the explanation thereof will be sometimes omitted.

In the third embodiment, the attached portion 62 and the planting portion 63 are substantially equal in external shape and in shape of central opening to each other, the central opening 61 of the cleaning pad 60 is constituted of those central openings. In the illustrated third embodiment, the diameter of the central opening 61 is about 8 cm but, from the usableness viewpoint, it may be usually 4–16 cm. Further, it is preferable to 6–12 cm. In the third embodiment, the attached portion 62 and the planting portion 63 have each a diameter of about 38 cm but, from the usableness viewpoint, the diameter may be usually 20–80 cm. Further, it is preferable to 30–60 cm.

The attached portion 62 may be made of nonwoven material that is piled and needle-punched webs each made of monofilaments. The lower surface of the nonwoven material is impregnated with at least one of rubber adhesive and rubber. Thus, the attached portion 62 comprises a flexible engaged layer 68 mainly made of nonwoven material so that a plenty of engaging pieces, which are provided in the lower surface of the driving pad of the electrically rotated floor-polisher, may be pierced therein, anal a flexible stopping layer 69 formed continuously with the lower surface of the engaged layer 68 and having comparably larger hardness so that the engaging pieces may be prevented from piercing therein. The attached portion 62 is not always made of nonwoven layer. It may be made of woven layer. The fiber, of which the nonwoven layer or the woven layer is constituted, may consist of polypropylene, polyethylene, polyvinyl chloride, polyvinylidene chloride or the like but, from the strength and good productivity viewpoint, it is particularly preferable that it consists of nonwoven layer made of polypropylene fibers. In the third embodiment, the thickness of the attached portion 62 is about 3 mm but, from the strength and usableness viewpoints, it is usually preferable to 1–9 mm. Further, it is much preferable to 2–6 mm.

In the illustrated third embodiment, the thickness of the engaged layer 68 is about 2 mm but, from the usableness viewpoint, it is usually preferable to 0.7–6 mm. Further, it is much preferable to 1.5–4 mm. In the illustrated third embodiment, the thickness of the stopping layer 69 is about 1 mm but, from the strength and usableness viewpoints, it is usually preferable to 0.3–3 mm. Further, it is much preferable to 0.5–2 mm. In the illustrated third embodiment, the ratio between the thickness of the engaged layer 68 and the thickness of the stopping layer 69 is about 0.5 but it is usually preferable to 0.1–2.0. Further, it is much preferable to 0.2–1.0. The stopping layer 69 is flexible like the engaged layer 68, but it has higher rigidity than the engaged layer 68, because the stopping layer 69 is impregnated with the rubber adhesive or the rubber.

Figure 21A:
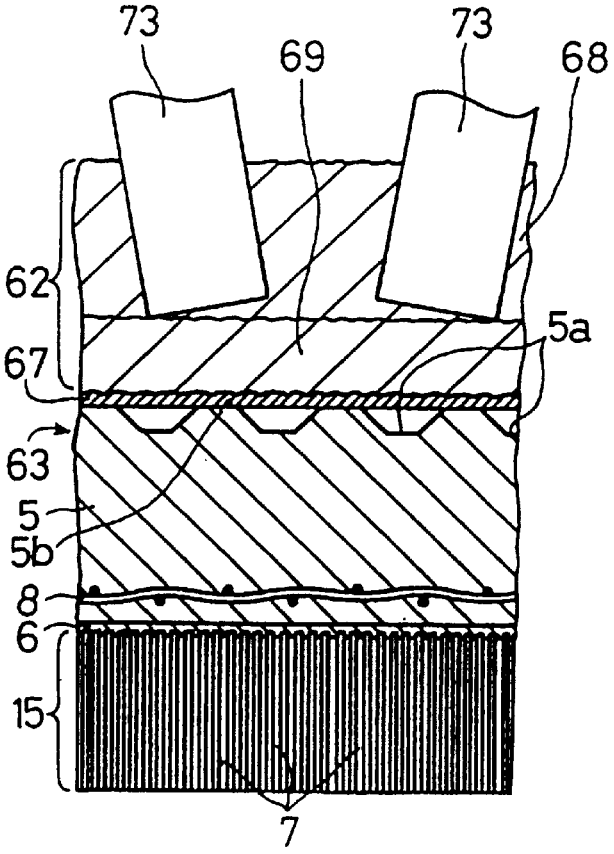
FIG. 21(A) is an enlarged longitudinal sectional view of a part of the cleaning pad shown in FIG. 20.
Figure 21B:
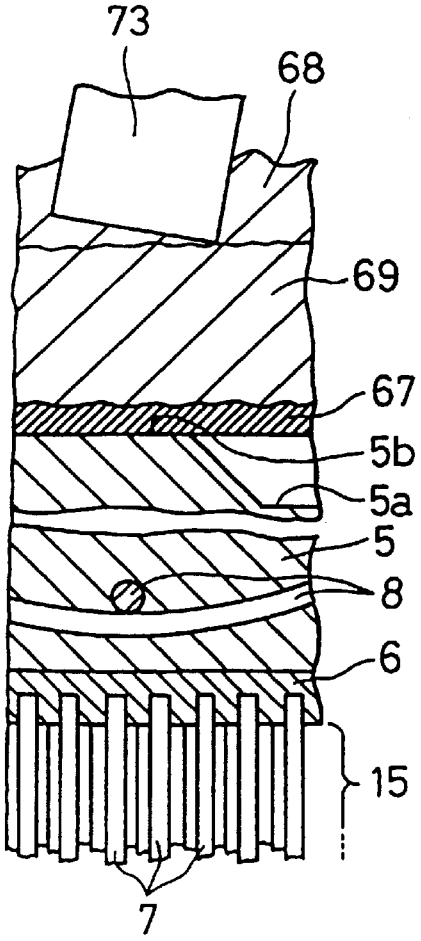
FIG. 21(B) is an enlarged view of a part of FIG. 21(A).

As plainly shown in FIGS. 21(A) and 21(B), the planting portion 63 comprises a flexible cushion layer or a flexible backing layer 5, the upper surface of which is adhered to the substantially flat lower surface of the stopping layer 69 of the attached portion 62 with a rubber adhesive or the other suitable adhesive 67, a reinforcement net 8 consisting of material for the net, such as glass fiber and embedded in the lower part of the backing layer 5, a fixing layer 6 consisting of a suitable adhesive and provided in the substantially flat lower surface of the backing layer 5, and a multiplicity of fibers 7, each lower end of which is fixedly planted in the fixing layer 6 one by one in an upright state and each remaining free part of which extends substantially vertically downwards. Thus, the free parts of the multiplicity of fibers 7, the parts not to be embedded in the fixing layer 6 form the pile layer 15 of substantially uniform thickness all over the fixing layer 6. In the illustrated third embodiment, the reinforcement net 8 has a group of substantially rectangular openings put side by side, each opening having an area of 4 mm×5 mm, and functions so as to reinforce the backing layer 5 and restrain the expansion, contraction, and bend of the backing layer 5. In order to plant the multiplicity of fibers 7 in the lower surface of the backing layer 5, an adhesive is applied to the lower surface of the backing layer 5 so as to form the fixing layer 6 and, before the adhesive is cured, the multiplicity of fibers 7 are made to catch at their one ends with the adhesive by the help of the electrostatic interaction. When the adhesive is cured, the fixing layer 6 is formed.

The backing layer 5 may be made of compound (that is, molding composition) having suitable elasticity and suitable water proofness, such as polyvinyl chloride (PVC), polyurethane resin, ethylene-propylene copolymer, synthetic rubber or the like but, from the good productivity viewpoint, PVC-compound is particularly preferable. In the illustrated third embodiment, the thickness; of the backing layer 5 constituted of PVC compound is about 3 mm but, from the usableness and cleaning-effect viewpoints, it is usually preferable to 0.8–8.0 mm. Further, it is much preferable to 1.5–5.0 mm. The Shore hardness of the backing layer 5 according to the third embodiment is about 50 but, from the usableness and cleaning effect viewpoints, it is usually preferable to 40–80. Further, it is much preferable to 45–60. The backing layer 5 is flexible like the engaged layer 68 and the stopping layer 69, but it has higher rigidity than the engaged layer 68 and the stopping layer 69.

In the upper surface of the backing layer 5, a lot of depressed portions 5*a* may be formed side by side, for example, by means of embossing finish of the flat surface. The depressed portion 5*a* according to the third embodiment is shaped into a substantially regular quadrangular truncated pyramid but it may be shaped into a substantially circular truncated cone, any of the various quadrangular truncated pyramids or other arbitrary shape. Further, the upper surface of the backing layer 5 may be made irregularly rugged. According to the illustrated third embodiment, the top surface of the regular quadrangular truncated pyramid (the bottom surface of the depressed portion 5*a*) has an area of about 1.5 mm×about 1.5 mm, the bottom surface of the pyramid (the edge of the depressed portion 5*a*) has an area of about 4 mm×about 4 mm, the depth of the depressed portion 5*a* is about 0.1 mm, and the pitch of the depressed portion 5*a* is about 6 mm both along its length and along its width. From the strength, good productivity and usableness viewpoints, it is preferable that the bottom surface of the arbitrarily shaped depressed portion 5*a* may usually have an area of 1–25 $mm^2$ and it is much preferable to 2–20 $mm^2$. The area of the edge of the depressed portion 5*a* is usually preferable to 8–200 $mm^2$ and much preferable to 4–100 $mm^2$ The depth of the depressed portion 5*a* is usually preferable to 0.2–2.0 mm and much preferable to 0.4–1.2 mm. Further, the pitch of the depressed portion 5*a* is usually preferable to 1–20 mm both along its length and its width and much preferable to 2.5–12 mm.

In the upper surface of the backing layer 5, there are many depressed portions 5*a* put side by side as described above, so that lattice-like protruberant portions 5*b* are formed in the upper surface. When the lattice-like protruberant portions 5*b* are adhered to the substantially flat lower surface of the stopping layer 69 of the attached portion 62 with an adhesive 67, the upper surface of the backing layer 5 is fixed to the lower surface of the attached portion 62.

The fiber 7 may comprise monofilament of resin or the like, which has suitable elasticity and suitable rigidity, such as nylon (nylon 6,6, nylon 6, nylon 6,10 or the like), polypropylene resin, polyethylene resin, polyvinyl chloride resin, polyvinylidene chloride resin, or the like but, from the cleaning-effect viewpoint, the fiber 7 of nylon, such as nylon 6,6, nylon 6, nylon 6,10 or the like is preferable and the fiber 7 of nylon 6,6 is particularly preferable. The elastic modulus of nylon 6,6 is about 28,100 $kg/cm^2$ when tested by ASTM, D638-52T but, in order to make the fiber 7 have suitable elasticity and suitable rigidity, the elastic modulus of the fiber 7 is usually preferable to 13,000–38,000 $kg/cm^2$ from the cleaning-effect and usableness viewpoints, and much preferable to 18,000–30,000 $kg/cm^2$. The fineness of the fiber 7 of nylon 6,6 according to the illustrated third embodiment may be about 15 denier or about 20 denier but, from the cleaning-effect and usableness viewpoints, it is usually preferable to 5–50 denier. Further, it is much preferable to 10–30 denier. The length of the fiber 7 according to the illustrated third embodiment is about 2.2 mm but, from the viewpoint of the practical use, it is usually preferable to 1.0–8.0 mm. Further, it is much preferable to 1.5–4.0 mm.

The planting density of the multiplicity of fibers 7 planted in the fixing layer 6 (in other words, the planting density of the pile layer 15) according to the illustrated third embodiment may be about 6,800 or about 8,000 filaments per $cm^2$ but, from the cleaning-effect and usableness viewpoints, it is usually preferable to 1,000–50,000 filaments/$cm^2$. Further, it is much preferable to 4,000–14,000 filaments/$cm^2$. The length of the part of the fiber 7, which is embedded in the fixing layer 6 (that is, the remaining part except the pile layer 15) according to the illustrated third embodiment is about 0.1 mm but, from the cleaning-effect and usableness viewpoints, it is usually preferable to 0.02–1.0 mm. Further, it is much preferable to 0.05–0.5 mm. Therefore, the length of the free end of the fiber 7, which is not embedded in the fixing layer 6 (that is, the thickness of the pile layer 15) according to the illustrated third embodiment is about 2.1 mm but, from the cleaning-effect and usableness viewpoints, it is usually preferable to 0.8–7.8 mm. Further, it is much preferable to 1.3–3.8 mm. The ratio between the length of the fiber 7 except the part of pile layer 15 and the thickness of pile layer 15 according to the illustrated third embodiment is about 1:21 but, from the strength viewpoint, it is usually preferable to 1:5 to 1:80. Further, it is much preferable to 1:10 to 1:50.

Figure 19:
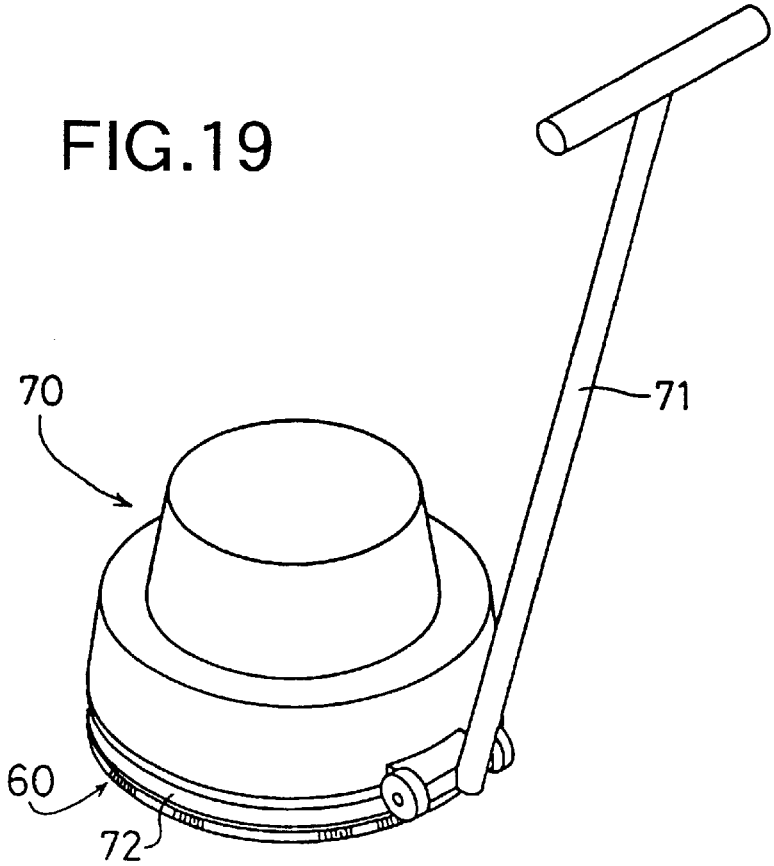
FIG. 19 is a perspective view of the electrically rotated floor-polisher, to which the cleaning pad shown in FIG. 18 is attached.
Figure 20:
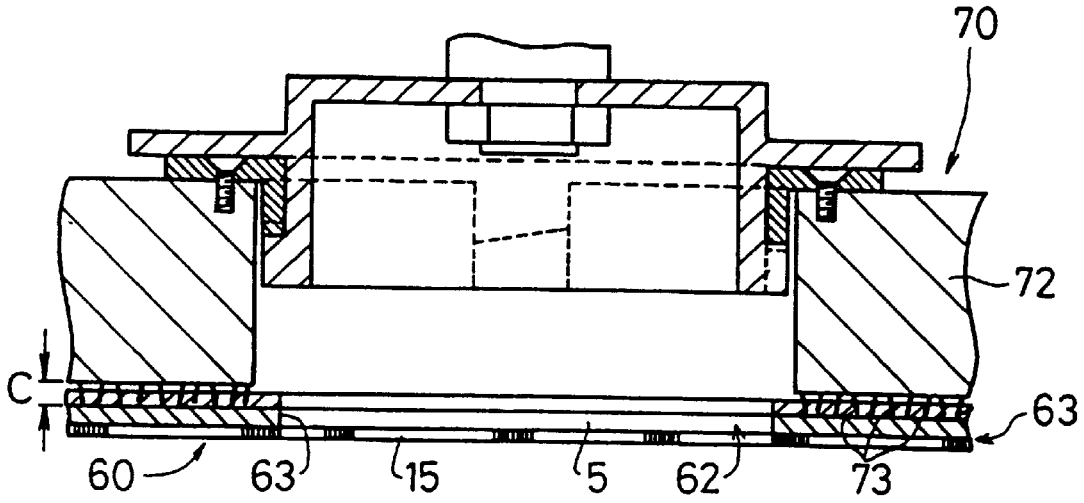
FIG. 20 is an enlarged longitudinal sectional view of the major elements of the electrically rotated floor-polisher shown in FIG. 19.

Subsequently, how to use the cleaning pad for the electrically rotted floor-polisher according to the illustrated third embodiment of this invention will be described. The cleaning pad 60 shown in FIG. 18 is removably attachable to the lower surface of the well-known driving pad 72 that can be removably attached to the well-known electrically rotated floor-polisher 70 having a handle 71 as shown in FIGS. 19–21. That is a lot of engaging pins 73 planted in the lower surface of the driving pad 72 and projecting in irregular directions, respectively, are pierced to the engaged layer 68 of the cleaning pad 60 to enable the driving pad 72 to hold the clearing pad 60 with the lot of its engaging pins 73. In that event, the tip of the engaging pin 73 abuts on the upper surface of the stopping layer 69 and is not pierced any more, so that a small gap C (FIG. 20) is made between the lower surface of the driving pad 72 and the upper surface of the engaged layer 68. Thus, the cleaning pad 60 can be attached to the driving pad 72 in such a state as to be bendable a little.

In the state that the cleaning pad 60 has been attached, the lower surface of the cleaning pad 60 is brought into contact with a surface (to be cleaned) like a floor so as to be able to polish the surface by the rotating cleaning-pad 60, after transmitting the torque of a drive motor (not shown) within the floor-polisher to the cleaning pad 60 through the driving pad 72. When it is desired to supply the liquid detergent or the like supplied from the floor-polisher 70 to the surface (to be cleaned), the detergent is dropped on the surface (to be cleaned) through a detergent supplying opening (not shown) of the polisher 70 and the central opening 61 of the cleaning pad 60. In that event, the lower ends of the multiplicity of fibers 7, of which the pile layer 15 is constituted, slip on the surface (to be cleaned) repeatedly, so that it is easy to surely and thoroughly clean the surface (to be cleaned) in a short time. Particularly, as the fiber 7, the backing layer 5, the engaged layer 68, and the stopping layer 69 have each suitable elasticity and suitable flexibility, and the fiber 7 is pertinently small in diameter and has suitable bending rigidity, the fiber 7 can be surely plunged even in narrow grooves and small pits of the surface to be cleaned. Thus, all the surface (to be cleaned) can be surely cleaned without any unclean portion.

It is noted that, in the third embodiment, the stopping layer 69 is provided besides the backing layer 5, but the backing layer 5 and the stopping layer 69 may be in one.

In the third embodiment, the central opening 61 is provided in the cleaning pad 60 but it is not always provided, for example, when it is not required to supply the liquid detergent or the like supplied from the floor-polisher 70 to the surface (to be cleaned).

Moreover, in the third embodiment, the cleaning pad 60 is shaped substantially into the disk, but it may be of rectangular shape or other arbitrary shape so as to fit its use. For example, when the cleaning pad 60 is used for a manually operated floor-polisher, for example, like a cleaning brush with a handle, it may be of substantially rectangular shape.

Moreover, in the third embodiment, the attached portion 62 and the planting portion 63 are substantially the same in shape but it is not always required.

Furthermore, in the third embodiment, the fiber 7 extends substantially vertically in the downward direction but, according to its use, the upper part of the fiber 7 may be embedded in the fixing layer 6 so that te fiber 7 may have slight inclination starting on the side of the outer periphery and slanting to the side of the central opening 61. In that event, the friction of the lover surface of the pile layer 15 is larger in the direction to the side of the outer periphery from the side of the central opening 61 than in the direction reverse thereof, so that it is possible to improve the cleaning effect of the cleaning pad 60 according to the third embodiment.

When the cleaning pad 60 according to the third embodiment is used, it is possible to thoroughly clean a very soiled rough surface in a short period of time even if the irregularity of the surface is either small or rather large.

When the cleaning pad 60 according to the third embodiment is used, it is easy to surely plunge the distal end of the monofilament, of which the pile layer 15 is constituted, into very narrow grooves or very narrow gaps, so that the very narrow grooves and gaps can be cleaned easily, surely and thoroughly without any unclean portion.

When the cleaning pad 60 according to the third embodiment is used, it does not occur that a liquid detergent sprinkles anywhere in the vicinity of the pile layer 15, when the pile layer 15 is impregnated with the liquid detergent and the strength and endurance of the planting portion 63 are very excellent.

As previously stated, the constitution, the function and the effect of this invention are concretely described in detail, but it should be understood that various modifications, replacements and changes can be made without departing from the spirit and the scope of the invention, which have been specified in the claims.

What is claimed is:

1. A cleaning brush comprising a mounting base and a pile layer provided on at least one surface of the mounting base, the shape of a surface on a free-end side of the pile layer being characterized by:

(1) having a long-side edge substantially straightly extending over the whole length of the pile layer;

(2) having an acutely projecting portion lying near each end of the long-side edge; and (3) providing a free-space in which neither the mounting base nor the pile layer is, and which is bounded by both a first imaginary line passing through each distal end of and extending perpendicular to the long-side edge, and a second imaginary line corresponding to a straight envelope line of an intermediate side edge and passing though each distal end of the long-side edge and forming an acute angle of between 4–40 degrees with the first imaginary line;

the mounting base being made of hard material and shaped into a substantially plate-like form, the one surface of the mounting base having a planting portion, an opposite surface of the mounting base having a handle portion, and the planting portion having a backing layer provided on the one surface of the mounting base, and the pile layer provided on the backing layer; and the pile layer being constituted of a multiplicity of monofilaments planted on the backing layer one by one in a substantially upright state and in density of 1,000–50,000 monofilaments per $cm^2$ so that the thickness of the pile layer is 0.8–7.8 mm, and the fineness and the elastic modulus (when tested by ASTM, D638-52T) of the monofilament are 5–50 denier and 13,000–38,000 $kg/cm^2$, respectively.

2. A cleaning brush according to claim 1 wherein the pile layer is constituted of the multiplicity of monofilaments planted on the backing layer one by one in the substantially upright state and in density of 4,000–14,000 filaments per $cm^2$ so that the thickness of the pile layer is 1.3–3.8 mm, and the fineness and the elastic modulus (when tested by ASTM, D638-52T) of the monofilament are 10–30 denier and 18,000–30,000 kg/cm$^2$, respectively.

3. A cleaning brush according to claim 2, wherein the monofilament is made of nylon 6,6.

4. A cleaning brush according to claim 1, wherein the mounting base and a lower surface of the pile layer are each substantially of isogonal-trapezoidal shape.

5. A cleaning brush according to claim 1, wherein the mounting base is 1–10 mm in thickness;

a grip portion provided on the handle portion is provided so as to extend along a longitudinal direction of the opposite surface of the mounting base and substantially in parallel with the opposite surface of the mounting base; and the Shore hardness and the thickness of the backing layer 40–80 and 0.5–5 mm, respectively.

6. A cleaning brush according to claim 5, wherein a reinforcement net is embedded in the backing layer.

7. A cleaning brush according to claim 5, wherein the surface, on the side of the mounting base, of the backing layer is made rugged.

8. A cleaning brush according to claim 5, wherein the mounting base is 1.5–5 mm in thickness; and the Shore hardness and the thickness of the backing layer are 45–60 and 1–3 mm, respectively.

9. A cleaning brush according to claim 1, wherein at least a long-side edge of at least the backing layer has an inclination starting at a lower end and slanting inwards to an upper end.

10. The cleaning brush according to claim 9, wherein the mounting base and backing layer have at least long-side edges having an inclination starting at a lower end of the backing layer and slanting inwards to an upper end of the mounting base.

11. A cleaning brush according to claim 10, wherein the angle of inclination is within the range of 25–75 degrees.

12. A cleaning brush according to claim 11, wherein the angle of the inclination is within the range of 30–60 degrees.

13. A cleaning brush according to claim 11, wherein the shape of the surface on the free-end side of the pile layer is characterized by:

(1) having the long-side edge in length of 12–35 cm, (2) a maximum width of the pile layer being 4–15 cm.

(3) being substantially the same as or a little larger than that of a lower surface of the mounting base, and (4) the acute angle of the free space being within 50–86 degrees.

14. A cleaning brush according to claim 13, wherein the shape of the surface on the free-end side of the pile layer is characterized by:

(1) the length of the long-side edge being 15–28 cm, (2) a maximum width of the pile layer being 5–10 cm, (3) having the second imaginary straight line inclining 8–25 degrees to the first imaginary straight line, (4) the acute angle of the free space being within 65–82 degrees.

15. A cleaning brush comprising a mounting base and a pile layer provided on at least one surface of the mounting base, the shape of a surface on a free-end side of the pile layer being characterized by:

(1) having a long-side edge substantially straightly extending over the whole length of the pile layer;

(2) having an acutely projecting portion lying near each end of the long-side edge; and (3) providing a free-space in which neither the mounting base nor the pile layer is, and which is bounded by both a first imaginary line passing through each distal end of and extending perpendicular to the long-side edge, and a second imaginary line corresponding to a straight envelope line of an intermediate side edge and passing through each distal end of the long-side edge and forming an acute angle of between 4–40 degrees with the first imaginary line;

the mounting base being made of hard material the one surface of the mounting base having a planting portion, an opposite surface having a handle portion, and the planting portion having a backing layer provided on the one surface of the mounting base, and the pile layer provided on the backing layer;

the mounting base being 1–10 mm in thickness and being shaped into a substantially flat plate-like form;

a grip portion being provided so as to extend alone, a longitudinal direction of the opposite surface of the mounting plate and substantially in parallel with the opposite surface; and the Shore hardness and the thickness of the backing layer being 40–80 and 0.5–5 mm, respectively.

16. A cleaning brush according to claim 15, wherein a reinforcement net is embedded in the backing layer.

17. A cleaning brush according to claim 15, wherein a surface, on the side of the mounting base, of the backing layer is made rugged.

18. A cleaning brush according to claim 15, wherein the mounting base is 1.5–5 mm in thickness; and the Shore hardness and the thickness of the backing layer are 45–60 and 1–3 mm, respectively.

19. A cleaning brush comprising a mounting base and a pile layer provided on at least one surface of the mounting base, the shape of a surface on a free-end side of the pile layer being characterized by:

(1) having a long-side edge substantially straightly extending over the whole length of the pile layer;

(2) having an acutely projecting portion lying near each end of the long-side edge; and (3) providing a free-space in which neither the mounting base nor the pile layer is, and which is bounded by both a first imaginary line passing through each distal end of and extending perpendicular to the long-side edge, and a second imaginary line corresponding to a straight envelope line of an intermediate side edge and passing through each distal end of the long-side edge and forming an acute angle of between 4–40 degrees with the first imaginary line;

the mounting base being made of hard material and shaped into a substantially plate-like form the one surface of the mounting base having a planting portion, an opposite surface of the mounting base having a handle portion, and the planting portion having a backing layer provided on the one surface of the mounting base, and the pile layer provided on the backing layer; and the shape of the surface on the free-end side of the pile layer being further characterized by:

(4) having the long-side edge in length of 12–35 cm, (5) a maximum width of the pile layer being 4–15 cm, (6) being substantially the same shape as or a little larger than that of a lower surface of the mounting base, and (7) the acute angle of the free space being within 50–86 degrees.

20. A cleaning brush according to claim 19, wherein the shape of the surface on the free-end side of the pile layer is characterized by:

(1) the length of the long-side edge being 15–28 cm, (2) a maximum width of the pile layer being 5–10 cm, (3) having the second imaginary straight line inclining 8–25 degrees to the first imaginary straight line, (4) the acute angle of the free space being within 65–82 degrees.

21. A cleaning brush comprising a mounting base and a pile layer provided on at least one surface of the mounting base, the shape of a surface on a free-end side of the pile layer being characterized by:

(1) having a long-side edge substantially straightly extending over the whole length of the pile layer;

(2) having an acutely projecting portion lying near each end of the long-side edge; and (3) providing a free-space in which neither the mounting base nor the pile layer is, and which is bounded by both a first imaginary line passing through each distal end of and extending perpendicular to the long-side edge, and a second imaginary line corresponding to a straight envelope line of an intermediate side edge and passing through each distal end of the long-side edge and forming an acute angle of between 4–40 degrees with the first imaginary line;

the mounting base comprising a blockish grip portion having softness and elasticity;

the blockish grip portion being formed out of foamed material having a thickness of 3–100 mm, a longitudinal elastic modulus of 0.4–3.0 kg/cm$^2$, and a porosity of 45–95%; and the pile layer being constituted of a multiplicity of monofilaments planted on a backing layer one by one in a substantially upright state and in a density of 1,000–50,000 monofilaments per cm$^2$ so that the thickness of the pile layer is 0.8–7.8 mm, and fineness and the elastic modulus (when tested by ASTM, D638-52T) of the monofilaments are 5–50 denier and 13,000–38,000 kg/cm$^2$, respectively.

22. A cleaning brush according to claim 21, wherein the blockish grip portion is formed out of foamed material having a thickness of 5–50 mm, a longitudinal elastic modulus of 0.6–1.8 kg/cm$^2$, and a porosity of 55–85%;

the pile layer is constituted of a multiplicity of monofilaments planted on the backing layer one by one in a substantially upright state and in density of 4,000–14,000 monofilaments per cm$^2$ so that the thickness of the pile layer is 1.3–3.8 mm, and the fineness and the elastic modulus (when tested by ASTM, D638-52T) of the monofilament are 10–30 denier and 18,000–30,000 kg/cm$^2$, respectively.

23. A cleaning brush comprising a planting portion provided on one surface of a mounting base that is made of hard material and shaped into a substantially plate-like form, and a handle portion provided on the other opposite surface of the mounting base;

the planting portion having a backing layer provided on the one surface of the mounting base, and a pile layer provided on the backing layer; and the pile layer being constituted of a multiplicity of monofilaments planted on the backing layer one by one in a substantially upright state and in density of 1,000–50,000 monofilaments per cm$^2$ so that the thickness of the pile layer is 0.8–7.8 mm, and the fineness and the elastic modulus (when tested by ASTM, D638-52T) of the monofilament are 5–50 denier and 13,000–38,000 kg/cm$^2$, respectively.

24. A cleaning brush according to claim 23, wherein the pile layer is constituted of the monofilaments planted on the backing layer one by one in a substantially upright state and in density of 4,000–14,000 filaments per cm$^2$ so that the thickness of the pile layer is 1.3–3.8 mm, and the fineness and the elastic modulus (when tested by ASTM, D638-52T) of the monofilament being 10–30 denier and 18,000–30,000 kg/cm$^2$, respectively.

25. A cleaning brush according to claim 24, wherein the monofilament is made of nylon 6,6.

26. A cleaning brush according to claim 23 wherein at least one side edge of the mounting base and of the backing layer has an inclination starting at a lower end of the backing layer and slanting inwards to an upper end of the mounting base; and the angle of inclination is within the range of 30–60 degrees.

27. A cleaning brush comprising a blockish grip portion having softness and elasticity, and a pile layer provided on at least one surface of the blockish grip portion; and the pile layer being constituted of a multiplicity of monofilaments planted one by one in a substantially upright state and in density of 1,000–50,000 monofilaments per cm$^2$ so that the thickness of the pile layer is 0.8–7.8 mm, and the fineness and the elastic modulus (when tested by ASTM, D638-52T) of the monofilament are 5–50 denier and 13,000–38,000 kg/cm$^2$, respectively.

28. A cleaning brush according to claim 27, wherein the pile layer is constituted of a multiplicity of monofilaments planted one by one in a substantially upright state and in density of 4,000–14,000 filaments per cm$^2$ so that the thickness of the pile layer is 1.3–3.9 mm, and the fineness and the elastic modulus (when tested by ASTM, D638-52T) of the monofilament are 10–30 denier and 18,000–30,000 kg/cm$^2$, respectively.

29. A cleaning brush according to claim 28, wherein the monofilament is made of nylon 6,6.

30. A cleaning brush according to claim 27, wherein a planting portion is provided on at least the one surface of the blockish grip portion; and the planting portion has a backing layer provided on at least the one surface of the blockish grip portion, and the pile layer planted on the backing layer.

31. A cleaning brush according to claim 30, wherein the blockish grip portion is made of foamed material having a longitudinal elastic modulus of 0.4–3.0 kg/cm$^2$ and a porosity of 45–95%, and is in thickness of 3–100 mm; and the Shore hardness and the thickness of the backing layer are 35–75 and 0.6–6.0 mm, respectively.

32. A cleaning brush according to claim 31, wherein the blockish grip portion is made of foamed material having a longitudinal elastic modulus of 0.6–1.8 kg/cm$^2$ and a porosity of 55–85%, and is in thickness of 5–50 mm; and the Shore hardness and the thickness of the backing layer are 40–60 and 1.0–4.0 mm, respectively.

33. A cleaning brush according to claim 32, wherein a reinforcement net is embedded in the backing layer.

34. A cleaning brush according to claim 32, wherein a surface, on the side of the blockish grip portion, of the backing layer is made rugged.

35. A cleaning brush according to claim 30, wherein at least one side edge of the backing layer has an inclination starting at a lower end and slanting inwards to an upper end.

36. A cleaning brush according to claim 35, wherein the angle of inclination is within the range of 25–75 degrees.

37. A cleaning brush according to claim 36, wherein the angle of inclination is within the range of 30–60 degrees.

38. A cleaning brush according to claim 31, wherein the length and the width of the blockish grip portion are 6–30 cm and 4–15 cm, respectively.

39. A cleaning brush according to claim 38, wherein the length and the width of the blockish grip portion are 10–20 cm and 5–10 cm, respectively.

40. A cleaning brush comprising a blockish grip portion having softness and elasticity, and a pile layer provided on at least one surface of the blockish grip portion;

the pile layer being constituted of a multiplicity of monofilaments planted one by one in a substantially upright state;

a planting portion being provided on at least the one surface of the blockish grip portion;

the planting portion having a backing layer provided on at least the one surface of the blockish grip portion, and the pile layer planted in the backing layer;

the blockish grip portion being made of foamed material having a longitudinal elastic modulus of 0.4–3.0 kg/cm$^2$ and a porosity of 45–95%, and being in thickness of 3–100 mm; and the Shore hardness and the thickness of the backing layer are 35–75 and 0.6–6.0 mm, respectively.

41. A cleaning brush according to claim 40, wherein the blockish grip portion is made of foamed material having the longitudinal elastic modulus of 0.6–1.8 kg/cm$^2$ and the porosity of 55–85%, and is in thickness of 5–50 mm; and the Shore hardness and the thickness of the backing layer are 40–60 and 1.0–4.0 mm, respectively.

42. A cleaning brush according to claim 41, wherein a reinforcement net is embedded in the backing layer.

43. A cleaning brush according to claim 41, wherein a surface, on the side of the blockish grip portion, of the backing layer is made rugged.

44. A cleaning brush according to claim 40, wherein the length and the width of the blockish grip portion are 6–30 cm and 4–15 cm, respectively.

45. A cleaning brush according to claim 44, wherein the length and the width of the blackish grip portion are 10–20 cm and 5–10 cm, respectively.

46. A cleaning brush comprising a blockish grip portion having softness and elasticity, and a pile layer provided on at least one surface of the blockish grip portion;

the pile layer being constituted of a multiplicity of monofilaments planted one by one in a substantially upright state;

a planting portion being provided on at least the one surface of the blockish grip portion;

the planting portion having a backing layer provided on at least the one surface of the blockish grip portion, and the pile layer planted in the backing layer; and the backing layer having at least one side edge with an inclination starting at a lower end and slanting inwards to an upper end.

47. A cleaning brush according to claim 46, wherein the angle of inclination is within the range of 25–75 degrees.

48. A cleaning brush according to claim 46, wherein the angle of the inclination is within 30–60°.

49. A cleaning pad for a polisher, comprising an engaged layer to be engaged with the polisher, and a pile layer provided on one surface of the engaged layer;

the pile layer being constituted of a multiplicity of monofilaments planted one by one in a substantially upright state;

the outer periphery of the engaged layer being of substantially circular shape so as to be engaged with engaging pins of the polisher;

a planting portion being provided on the one surface of the engaged layer; and the planting portion having a backing layer provided on the one surface of the engaged layer, and the pile layer planted in the backing layer;

wherein a central opening shaped into a substantially circular form is provided in the engaged layer;

the engaged layer is made of unwoven material and is 0.7–6 mm in thickness; and the backing layer has a Shore hardness of 40–80 and a thickness of 0.8–8.0 mm.

50. A cleaning pad according to claim 49, wherein the engaged layer is 1.5–4 mm in thickness; and the backing layer has a Shore hardness of 45–60 and a thickness of 1.5–5.0 mm.

51. A cleaning pad according to claim 50, wherein a reinforcement net is embedded in the backing layer.

52. A cleaning pad according to claim 50, wherein a surface, on the side of the engaged layer, of the backing layer is made rugged.

53. A cleaning pad according to claim 49, wherein the engaged layer and planting portion are each 20–80 cm in diameter; and the engaged layer has a central opening 6–12 cm in diameter.

54. A cleaning pad according to claim 53, wherein the engaged layer and the planting portion are each 30–60 cm in diameter; and the central opening is 6–12 cm in diameter.

55. A cleaning pad according to claim 50, wherein the unwoven material is what needle-punches a web of monofilaments to laminate it.

56. A cleaning pad according to claim 55, wherein the laminated unwoven material is impregnated with at least either of rubber adhesive or rubber on the side of the pile layer and, thereby, a stopping layer is formed integrally with the engaged layer.

57. A cleaning pad according to claim 56, wherein the thickness of the stopping layer is within the range of 0.3–3 mm.

58. A cleaning pad according to claim 56, wherein the thickness of the stopping layer is within the range of 0.5–2 mm.

59. An electrically rotated floor-polisher in which a cleaning pad according to claim 56 is removably attached to the lower surface of the polisher's driving pad.

60. A cleaning pad for a polisher, comprising an engaged layer to be engaged with the polisher, and a pile layer provided on one surface of the engaged layer;

the outer periphery of the engaged layer being of substantially circular shape so as to be engaged with engaging pins of the polisher;

the pile layer being constituted of a multiplicity of monofilaments planted one by one in a substantially upright state and in a density of 1.000–50.000 monofilaments per cm$^2$ so that the thickness of the pile layer is 0.8–7.8 mm, and the fineness and the elastic modulus (when tested by ASTM, D638-52T) of the monofilaments are 5–50 denier and 13.000–38.000 kg/cm$^2$, respectively;

a planting portion being provided on the one surface of the engaged layer, the planting portion having a backing layer provided on the one surface of the engaged layer and the pile layer planted in the backing layer;

wherein the engaged layer is made of unwoven material and is 0.7–6 mm in thickness; and the Shore hardness and the thickness of the backing layer are 40–80 and 0.8–8.0 mm, respectively.

61. A cleaning pad according to claim 60, wherein a central opening shaped into a substantially circular form is provided in the engaged layer; and the pile layer is constituted of a multiplicity of monofilaments planted one by one in a substantially upright state and in density of 4,000–14,000 monofilaments per $cm^2$ so that the thickness of the pile layer is 1.3–3.8 mm, and the fineness and the elastic modulus (when tested by ASTM, D638-52T) of the monofilament are 10–30 denier and 18,000–30,000 $kg/cm^2$, respectively.

62. A cleaning pad according to claim 61, wherein the monofilament is made of nylon 6,6.

63. A cleaning pad according to claim 60, wherein the engaged layer is made of unwoven material and is 1.5–4 mm in thickness; and the Shore hardness and the thickness of the backing layer are 45–60 and 1.5–5.0 mm, respectively.

64. A cleaning pad according to claim 63, wherein a reinforcement net is embedded in the backing layer.

65. A cleaning pad according to claim 63, wherein a surface, on the side of the engaged layer, of the backing layer is made rugged.

66. A cleaning pad according to claim 63, wherein the unwoven material is a needle-punched web made of monofilaments.

67. A cleaning pad according to claim 66, wherein the unwoven material is impregnated with at least either of rubber adhesive or rubber on the side of the pile layer and, thereby, a stopping layer is formed integrally with the engaged layer.

68. A cleaning pad according to claim 67, wherein the thickness of the stopping layer is within the range of 0.3–3 mm.

69. A cleaning pad according to claim 68, the thickness of the stopping layer is within the range of 0.5–2 mm.

70. An electrically rotated floorpolisher in which a cleaning pad according to claim 67 is removably attached to the lower surface of the polisher's driving pad.

71. A cleaning pad according to claim 60, wherein the engaged layer and the planting portion are each 20–80 cm in diameter; and the engaged layer has a central opening that is 4–16 cm in diameter.

72. A cleaning pad according to claim 71, wherein the engaged layer and the planting portion are each 30–60 cm in diameter; and the central opening is 6–12 mm in diameter.

* * * * *